US011446211B2

(12) United States Patent
Berenshteyn et al.

(10) Patent No.: US 11,446,211 B2
(45) Date of Patent: Sep. 20, 2022

(54) VARIABLE, MULTI-DOSE MICROTABLET DISPENSER

(71) Applicant: MERCK SHARP & DOHME LLC, Rahway, NJ (US)

(72) Inventors: Annaniy Berenshteyn, Edgewater, NJ (US); Mikhail Gotliboym, Scotch Plains, NJ (US); Christopher Granelli, Chatham, NJ (US)

(73) Assignee: MERCK SHARP & DOHME LLC, Rahway, NJ (US)

( * ) Notice: Subject to any disclaimer, the term of this patent is extended or adjusted under 35 U.S.C. 154(b) by 287 days.

(21) Appl. No.: 16/782,388

(22) Filed: Feb. 5, 2020

(65) Prior Publication Data

US 2020/0268612 A1 Aug. 27, 2020

Related U.S. Application Data

(60) Provisional application No. 62/808,563, filed on Feb. 21, 2019.

(51) Int. Cl.
*A61J 7/00* (2006.01)
*B65D 83/04* (2006.01)

(52) U.S. Cl.
CPC ..... *A61J 7/0076* (2013.01); *B65D 83/0454* (2013.01)

(58) Field of Classification Search
CPC ..... A61J 7/0069; A61J 7/0076; A61J 7/0084; A61M 15/0048; A61M 15/0075;
(Continued)

(56) References Cited

U.S. PATENT DOCUMENTS 6,273,294 B1 8/2001 Petzold et al.
6,811,054 B1 11/2004 Moest
2017/0190503 A1 7/2017 French et al.

FOREIGN PATENT DOCUMENTS

CA 2272162 A1 11/2000
CN 104960787 A 10/2015
(Continued)

OTHER PUBLICATIONS

Food and Drug Administration, Guidance For Industry Size of Beads in Drug Products Labeled for Sprinkle, ., 2012, 1-4, Rev. 1.

*Primary Examiner* — Gene O Crawford
*Assistant Examiner* — Kelvin L Randall, Jr.
(74) *Attorney, Agent, or Firm* — Janet E. Fair; Alysia Finnegan

(57) ABSTRACT

A microtablet dispenser is provided herein including: a microtablet reservoir disc including a plurality of wells each formed to accommodate at least one microtablet, the wells being arranged in at least one array; a screen plate having at least one opening shaped to expose all of the wells of one of the arrays when aligned therewith; and, a dose selector plate including a plurality of dosing apertures arranged in a plurality of dosing arrays of different patterns. With one of the arrays being aligned with the at least one opening of the screen plate and with a selected dosing array, the microtablets accommodated in the wells aligned with dosing apertures are free to pass through the corresponding dosing apertures so as to be dispensed therefrom, while the wells of the array not aligned with dosing apertures are obstructed by solid portions of the dose selector plate.

27 Claims, 23 Drawing Sheets

(58) Field of Classification Search
CPC ..... B65D 55/02; B65D 83/0409; B65D 83/0445; B65D 83/0454; B65D 2215/04; B65D 2483/0459
See application file for complete search history.

(56) References Cited

FOREIGN PATENT DOCUMENTS

| | | | |
|---|---|---|---|
| CN | 106347870 | A | 1/2017 |
| CN | 206704935 | U | 12/2017 |
| CN | 107554997 | A | 1/2018 |
| CN | 206827345 | U | 1/2018 |
| CN | 107826445 | A | 3/2018 |
| DE | 29713884 | U1 | 11/1997 |
| DE | 102004001645 | A1 | 8/2005 |
| JP | 2014184962 | A | 10/2014 |
| KR | 1767409 | B1 | 8/2017 |
| WO | 2005005280 | A1 | 1/2005 |
| WO | 2012024668 | A2 | 2/2012 |

VARIABLE, MULTI-DOSE MICROTABLET DISPENSER

BACKGROUND OF THE INVENTION

Microtablets, also known as minitablets, are smaller than normal sized tablets having a size generally in the range of 1-4 millimeters. Microtablets allow for greater customization of a dose of drug for a patient, since the prescribed amount can be adjusted in much smaller increments than with standard sized tablets. This may be additionally beneficial for patients who require weaker prescriptions, such as, children, elderly patients, and frail patients.

Due to the small size of microtablets, dose accuracy may be difficult, particularly, as to handling, counting, etc. In addition, depending on a patient's condition, the size of the dose may need to be varied from dose to dose depending on the state of the patient. Microtablet dispensers have been developed in the prior art, such as shown in U.S. Pat. No. 6,811,054, issued on Nov. 2, 2004, to Moest et al., which provide for the establishment of a single, fixed dose of microtablets. These dispensers, however, do not provide for variability in the dose.

Tablet dispensers have been also developed in the prior art which allow for variability in the number of tablets to dispense. For example, CN 106347870 A, dated Jan. 25, 2017, discloses a dispenser having multiple slidable barriers, with a barrier being selected to define the number of tablets to be dispensed. Also, CN 206704935 U, dated Dec. 5, 2017, discloses a rotatable disc having an adjustable-length channel defined therein, where the length of the channel is adjusted to the number of tablets to be dispensed. These devices, although having variability, are limited in the quantities of tablets that can be selected. The associated hardware constrains the range of the number of dispensable tablets.

SUMMARY OF THE INVENTION

A variable, multi-dose microtablet dispenser is provided herein including: a microtablet reservoir disc including a plurality of wells each formed to accommodate at least one microtablet, the wells being arranged in at least one discrete array; a screen plate having opposing first and second faces and at least one opening therethrough shaped to expose all of the wells of one of the arrays when aligned therewith, wherein, the microtablet reservoir disc is located adjacent to the first face of the screen plate with the microtablet reservoir disc being rotationally adjustable relative to one another; and, a dose selector plate including a plurality of dosing apertures extending therethrough, the dosing apertures being arranged in a plurality of dosing arrays, each of the dosing arrays defining a different pattern of the dosing apertures, wherein, the dose selector plate being located adjacent to the second face of the screen plate, the dose selector plate being rotationally adjustable relative to the screen plate. The microtablet dispenser is readied for dispensing a dose with rotational adjustment of the dose selector plate relative to the screen plate to align a selected one of the dosing arrays with a dosing position. With a first of the arrays of the microtablet reservoir disc being in alignment with the at least one opening of the screen plate and with the selected dosing array in the dosing position, the wells of the first array are aligned with the dosing apertures of the selected dosing array based on the pattern of the dosing apertures of the selected dosing array such that the microtablets accommodated in the wells of the first array aligned with the dosing apertures of the selected dosing array are free to pass through the at least one opening and the corresponding dosing apertures so as to be dispensed therefrom, while the wells of the first array not aligned with the dosing apertures of the selected dosing array are obstructed by solid portions of the dose selector plate preventing the dispensing of the microtablets accommodated therein. Advantageously, the subject invention provides for multiple doses, in varying quantities, of microtablets.

As used herein, a "microtablet" is a tablet including one or more pharmaceutically and/or biologically active agents with the tablet having dimensions no greater than 5 millimeters in each of its width, length, and depth, more preferably, having dimensions no greater than 2.8 millimeters in each of its width, length, and depth (as set forth in "Guidance for Industry, Size of Beads in Drug Products Labeled for Sprinkle," U.S. Department of Health and Human Services, Food and Drug Administration, Center for Drug Evaluation and Research (CDER), May, 2012).

These and other features of the invention shall be better understood through a study of the following detailed description and accompanying drawings.

DETAILED DESCRIPTION OF THE INVENTION

Figure 1:
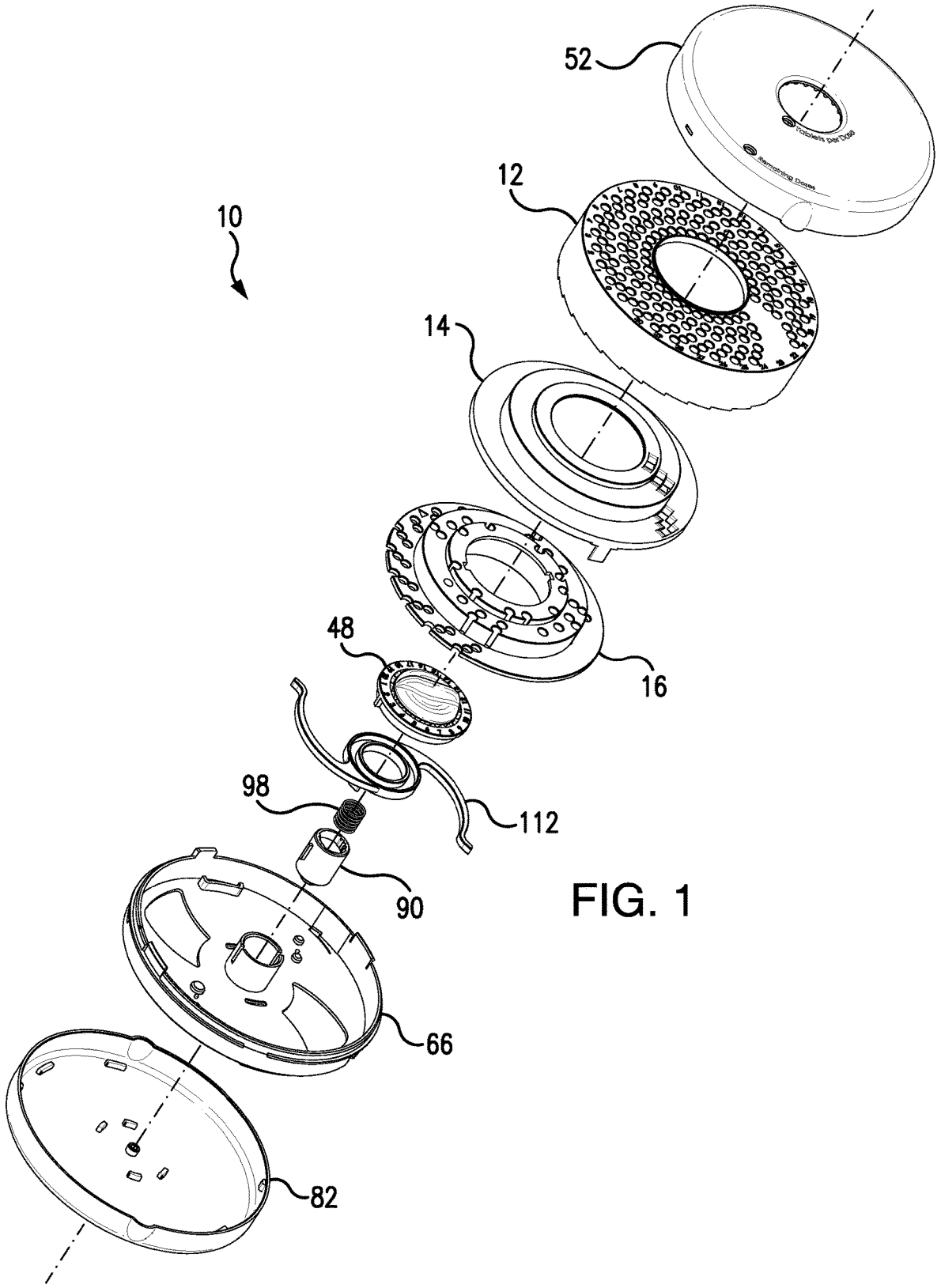
FIG. 1 is an exploded view of a microtablet dispenser in accordance with the subject invention.

With reference to FIG. 1, a microtablet dispenser is shown and generally designated with reference numeral 10. The dispenser 10 includes a microtablet reservoir disc 12, a screen plate 14, and a dose selector plate 16, which collectively allow for multiple, and variable, doses of microtablets to be dispensed by the dispenser 10.

FIG. 1 shows additional components beyond the reservoir disc 12, the screen plate 14, and the dose selector plate 16, which may be optionally included with the dispenser 10. For example a top housing 52 may be provided for overlaying over the reservoir disc 12, an upstanding handle 48 may be provided on the dose selector plate 14, a dosing plate 66 that can accommodate a coupling 90 for housing a spring 98 and a pawl 112, and the microtablet dispenser described herein may include a removable cover 82. Such additional features will be discussed below in more detail.

Figure 2:
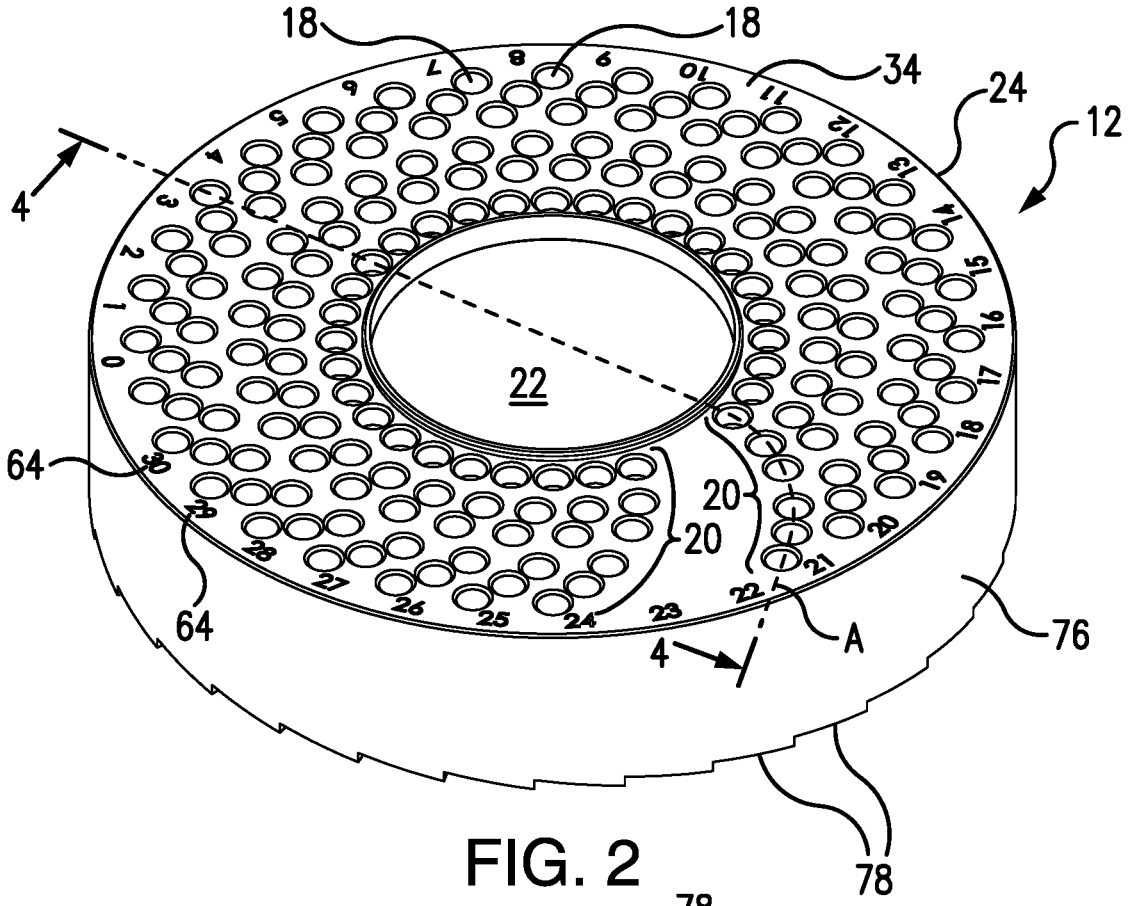
FIG. 2 shows a microtablet reservoir disc useable with the subject invention.
Figure 3:
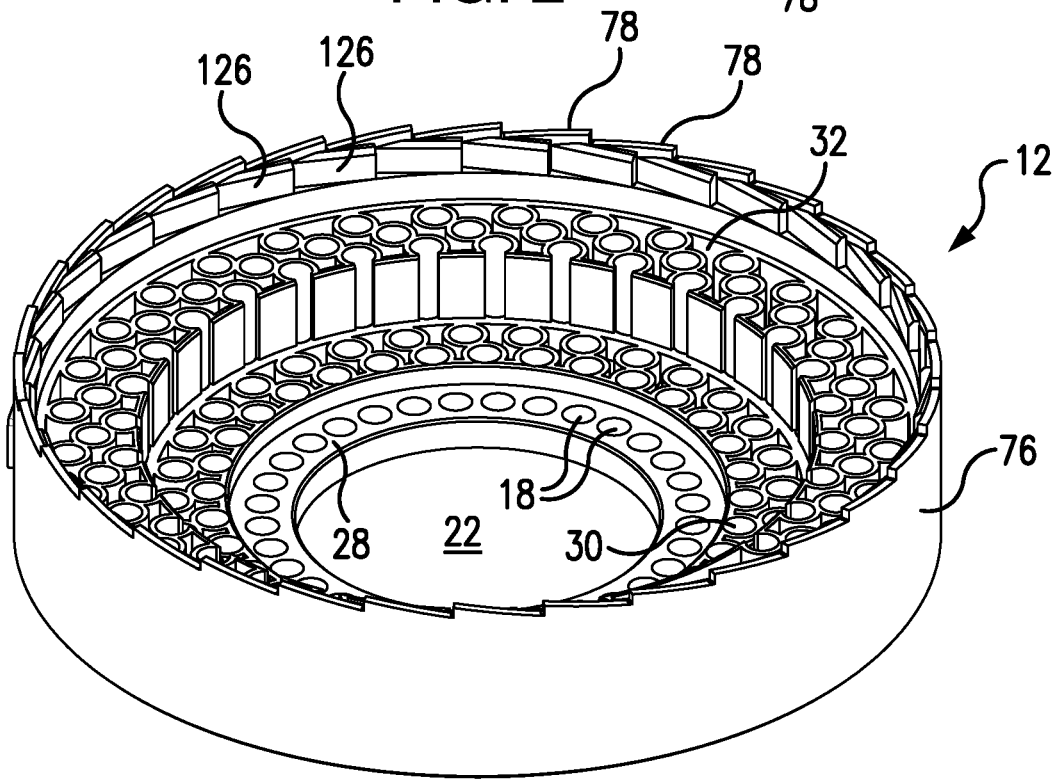
FIG. 3 shows a microtablet reservoir disc useable with the subject invention.
Figure 4:
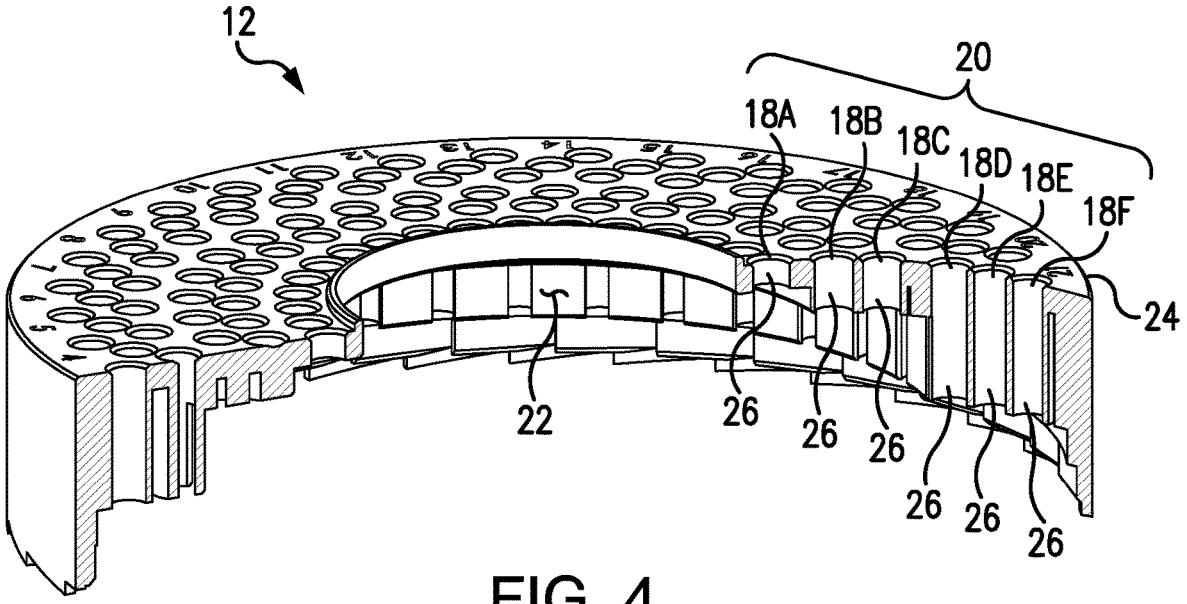
FIG. 4 is a cross-sectional view taken along line 4-4 of FIG. 2.

As shown in FIGS. 2, 3 and 4, the reservoir disc 12 includes a plurality of wells 18 each formed to accommodate at least one microtablet. The wells 18 are arranged in a plurality of discrete arrays 20. Each of the arrays 20 corresponds to an administerable dose of the microtablets. A plurality of the arrays 20 provides the dispenser 10 with a plurality of doses. For each of the arrays 20, the microtablets accommodated by the wells 18 within the respective array 20 collectively constitute a maximum quantity of microtablets dispensable as a dose. The subject invention allows for dose setting by a user so that a dose may be set for any quantity ranging from one microtablet to the maximum quantity. The dose can be set from dose to dose to permit the user to change the quantity as needed for each dose.

Preferably, for each of the arrays 20, the wells 18 are arranged along an arc, as represented by arc A in FIG. 2. More preferably, the reservoir disc 12 includes a central opening 22 and an outer edge 24 with the arrays 20 extending therebetween in parallel.

As shown in FIG. 4, each of the wells 18A-18D defines an open channel 26 for accommodating at least one of the microtablets. It is preferred that the open channels 26 of all of the wells 18 be provided with the same inner diameter, and, that the inner diameter be selected to ensure that the microtablets are all oriented within the channels 26 in one manner. For example, with spherical microtablets, the inner diameter of the channels 26 may be slightly greater than the diameter of the microtablets. With elongated microtablets, it is preferred that the longitudinal axis of the microtablets be aligned in parallel to the longitudinal axis of the respective channels 26; this can be achieved by setting the inner diameter of the channel 26 slightly greater than a circumference of the microtablets which is transverse to the longitudinal axis of the microtablets (i.e., the circumference which encircles the longitudinal axis). This allows for the microtablets to be oriented in only one manner. As a result, the quantity of microtablets which may be accommodated in each of the wells 18 will be a direct function of the depth of the wells 18, i.e., the depth of the channels 26.

Figure 5:
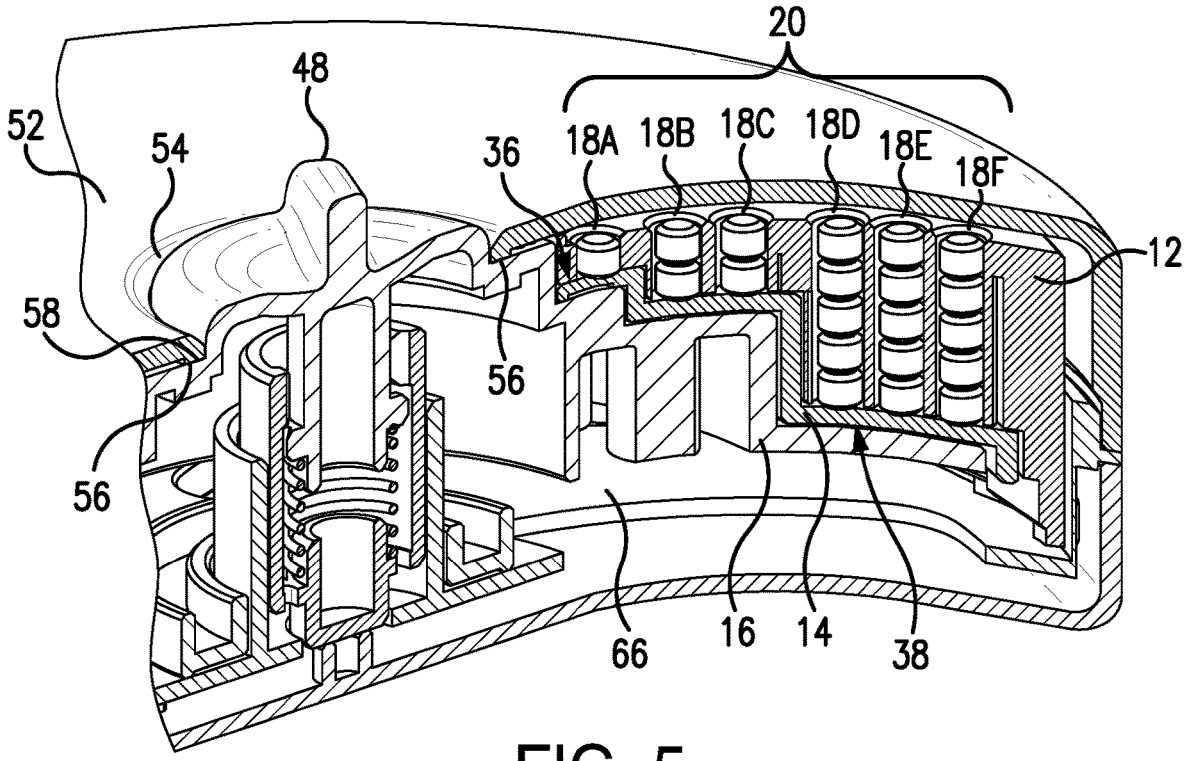
FIG. 5 shows a partial assembly of a microtablet dispenser in accordance with the subject invention.

It is preferred that within each of the arrays 20, the wells 18 be provided with different depths to allow for the accommodation of different quantities of microtablets. For example, as shown in FIG. 4, for each of the arrays 20, six of the wells 18 may be provided having three different depths: one well of one depth; two wells of a second depth; and, three wells of a third depth. By way of non-limiting example, and as shown in FIG. 5, a first well 18A may be provided with a depth to accommodate a single microtablet; second and third wells 18B, 18C may be each formed to accommodate two microtablets; and, fourth, fifth, and sixth wells 18D, 18E, 18F may be each formed to accommodate five microtablets. This arrangement allows for the selective dosing of one to twenty microtablets. As discussed further below, a user selects the dose and, based on the selection, particular wells are exposed to allow for the dispensing of accommodated microtablets. Depending on which wells are exposed, the total quantity of microtablets being dispensed may be controlled. The following table summarizes which of the wells 18A-18F are exposed to provide the noted quantities of microtablets:

| Quantity of Microtablets to be Dispensed | Exposed Wells |
|---|---|
| 1 | 18A |
| 2 | 18B |
| 3 | 18A, 18B |
| 4 | 18B, 18C |
| 5 | 18A, 18B, 18C |
| 6 | 18A, 18D |
| 7 | 18B, 18D |
| 8 | 18A, 18B, 18D |
| 9 | 18B, 18C, 18D |
| 10 | 18A, 18B, 18C, 18D |
| 11 | 18A, 18D, 18E |
| 12 | 18B, 18D, 18E |
| 13 | 18A, 18B, 18D, 18E |
| 14 | 18B, 18C, 18D, 18E |
| 15 | 18A, 18B, 18D, 18D, 18E |
| 16 | 18A, 18D, 18E, 18F |
| 17 | 18B, 18D, 18E, 18F |
| 18 | 18A, 18B, 18D, 18E, 18F |
| 19 | 18B, 18C, 18D, 18E, 18F |
| 20 | 18A, 18B, 18C, 18D, 18E, 18F |

It is preferred that, where possible, radially innermost wells be utilized, particularly where multiple options are available. For example, it is preferred that the second well 18B be utilized over the third well 18C, and that the fourth well 18D be utilized over the fifth and sixth wells 18E, 18F. Further, it is preferred that the combination of the first through third wells 18A, 18B, 18C be utilized as collectively dispensing five microtablets over any of the fourth through sixth wells 18D-18F. As will be appreciated by those skilled in the art, the number and depths of the wells 18 may be varied within the arrays 20 to cover different quantities of the microtablets. It is preferred that each of the arrays 20 be similarly configured to have the same quantity of the wells 18, arranged in the same fashion (e.g., along the arc A), with the wells 18, from array to array, having the same depths in the same arrangement (i.e., the depth at each well position is the same from array to array). The reservoir disc 12 is rotated in increments to align each of the arrays 20 with a target spot in allowing for sequential dosing with each of the arrays 20 representing a dose.

As can be seen in FIG. 3, it is preferred that the wells 18 of similar depth be arranged in rings about the central opening 22 on the reservoir disc 12. In this manner, the wells 18, across all of the arrays 20, are arranged in tiers, depending on depth. It is further preferred that the wells 18 with shortest depth be closest to the central opening 22 with increasing depth being located radially outward. For example, as shown in FIG. 3, the wells 18 of shortest depth (e.g., well 18A) may be arranged in a ring closest to the central opening 22 forming a first tier 28; the wells 18 of medium depth (e.g., wells 18B, 18C) may be arranged in a ring encircling the first tier 28 to define a second tier 30; and, the wells 18 of greatest depth (e.g., wells 18D, 18E, 18F) may be arranged in a ring encircling the second tier 30 to define a third tier 32.

As shown in FIGS. 2-4, the open channels 26 of the wells 18 are open on at least one end to allow for microtablets to be dispensed therefrom. Preferably, the open channels 26 are open in the planes of the tiers 28, 30, 32. The reservoir disc 12 may be provided with a generally flat upper face 34. Preferably, the wells 18 extend through the upper face 34 so that the open channels 26 are also open in the plane of the upper face 34. This arrangement allows for the loading of microtablets into the wells 18 through the upper face 34, during assembly of the dispenser 10.

Figure 6:
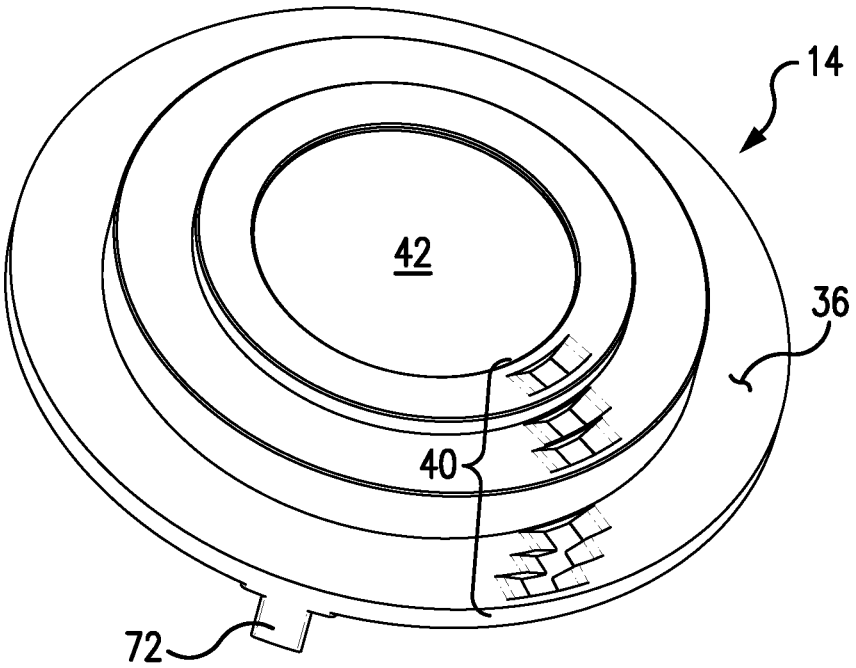
FIG. 6 shows a screen plate useable with the subject invention.
Figure 7:
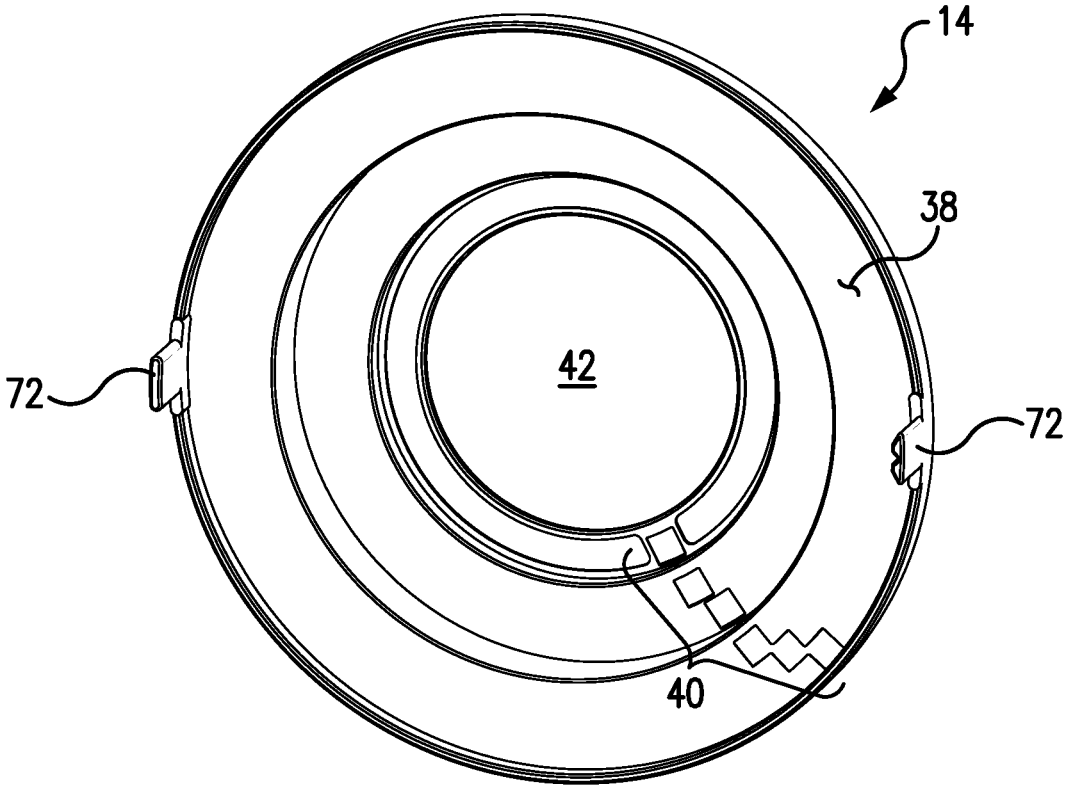
FIG. 7 shows a screen plate useable with the subject invention.

As shown in FIGS. 5-7, the screen plate 14 includes opposing first and second faces 36, 38 with the reservoir disc 12 being located adjacent to the first face 36. As shown in FIGS. 6 and 7, the screen plate 14 includes at least one opening 40 formed to expose all of the wells 18 of one of the arrays 20, shown in FIGS. 2-4, when aligned therewith. The screen plate 14 may be formed multi-tier to match the tiered profile of the reservoir disc 12. With this configuration, as shown in FIG. 6, the at least one opening 40 may be a plurality of openings spread over the multiple tiers. Each of the openings 40 is sized to allow passage therethrough of at least one microtablet. Collectively, the openings 40 are arranged to allow simultaneous passage therethrough of the microtablets accommodated by all of the wells 18 within one of the arrays 20, shown in FIGS. 2-4. Specifically, the at least one opening 40 is sized to span across one or more of the wells 18 of one of the arrays 20. For example, as shown in FIGS. 5, 6 and 7, one of the openings 40 may be provided to align with the first well 18A, two of the openings 40 may be provided to align with the second and third wells 18B, 18C, while one of the openings 40 may be provided to align with the fourth, fifth, and sixth wells 18D, 18E, 18F. The at least one opening 40 may be formed in any manner (continuous or discontinuous) which allows for simultaneously exposing all of the wells 18 of one of the arrays 20.

The screen plate 14 is provided with a central opening 42. The at least one opening 40 may be arranged to radiate outwardly from the central opening 42 along an arc shaped like the arc A discussed above. Preferably, the screen plate 14 is solid in all portions outside of the at least one opening 40. This allows for the screen plate 14 to obstruct the wells 18 which are not aligned with the at least one opening 40 in preventing uncontrolled dispensing of microtablets.

Figure 8:
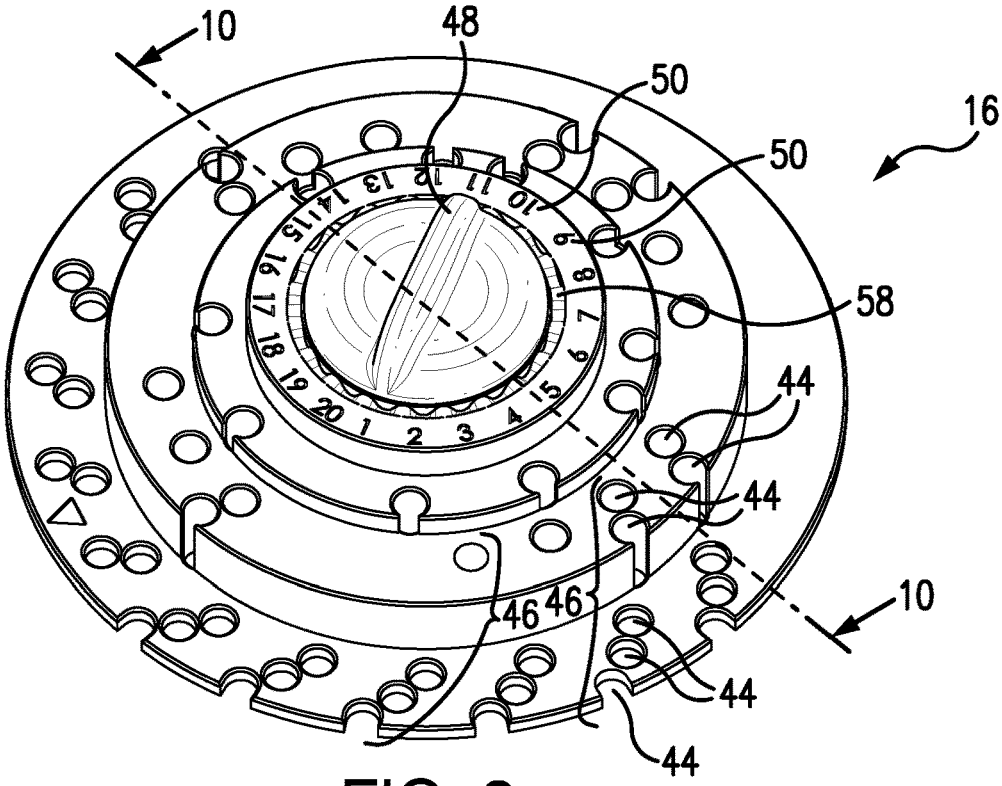
FIG. 8 shows a dose selector plate useable with the subject invention.
Figure 9:
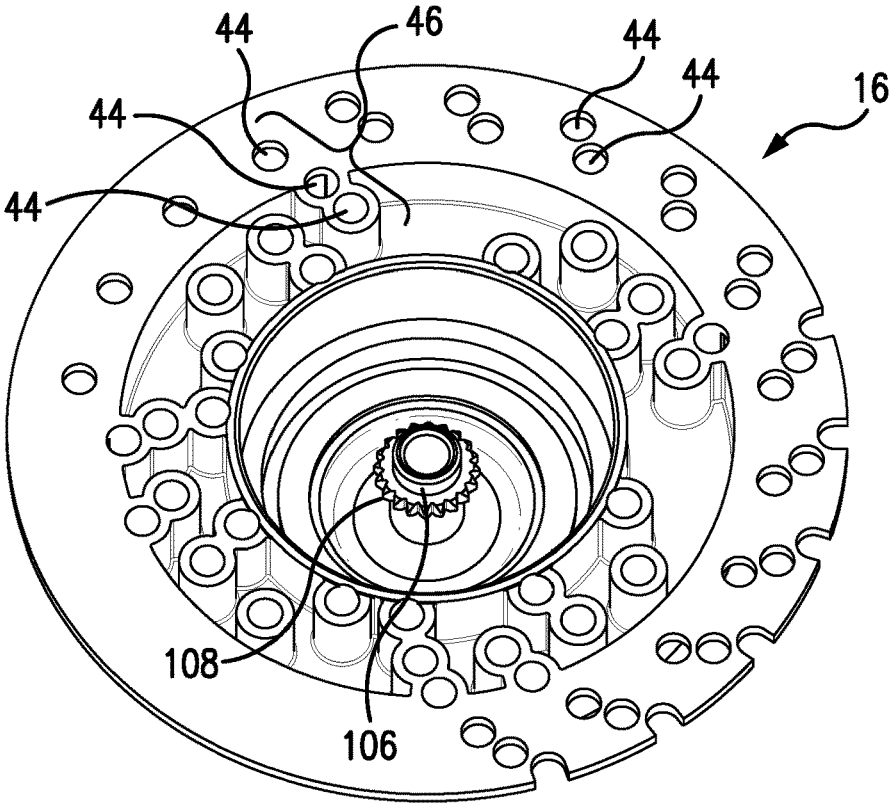
FIG. 9 shows a dose selector plate useable with the subject invention.
Figure 10:
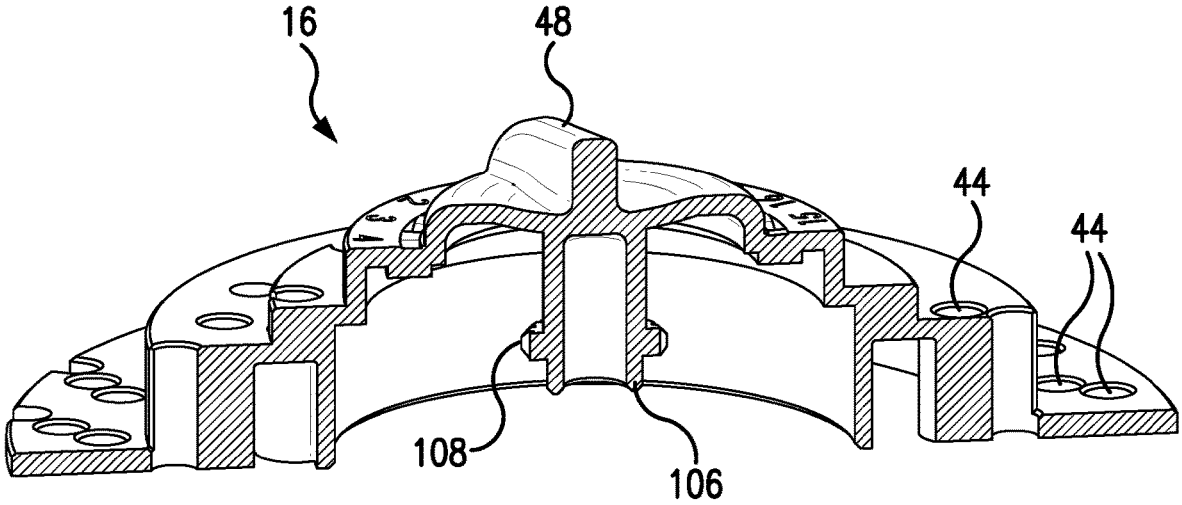
FIG. 10 is a cross-sectional view taken along line 10-10 of FIG. 8.

As shown in FIGS. 8-10, the dose selector plate 16 includes a plurality of dosing apertures 44 extending therethrough. Each of the dosing apertures 44 is sized to permit passage therethrough of microtablets. The dosing apertures 44 are arranged in a plurality of discrete dosing arrays 46. Each of the dosing arrays 46 defines a different pattern of the dosing apertures 44. The dosing arrays 46 allow a user to select different quantities of microtablets for a dose. This is achieved with, as shown in FIG. 9, the dosing apertures 44 being arranged within the dosing arrays 46 to expose wells 18 to allow for a target number of microtablets to be dispensed. In particular, based on a user-selected dose amount, the corresponding dosing array 46 is aligned with one of the arrays 20 with the dosing apertures 46 only exposing the wells 18 from which the microtablets are to be dispensed (the non-exposed wells 18 being obstructed to not dispense microtablets). The dosing apertures 44 may be arranged along an arc (e.g., along the arc A) within each of the dosing arrays 46.

As shown in FIGS. 11-14, the dose selector plate 16 is located adjacent to the second face 38 of the screen plate 14, which includes opposing first and second faces 36, 38. The dose selector plate 16 is rotatable relative to the screen plate 14 so that the dosing arrays 46, shown in FIGS. 8 and 9, are selectively alignable with the at least one opening 40, shown in FIG. 7. With rotation of the reservoir disc 12 relative to the screen plate 14, and with rotation of the dose selector plate 16 relative to the screen plate 14, the wells 18A-18F may be brought sequentially into alignment with the at least one opening 40, shown in FIGS. 6 and 7, of the screen plate 14 and into alignment with one of the dosing arrays 46, shown in FIG. 8, as selected by a user. The at least one opening 40 provides no obstruction to microtablets dispensing from the wells 18 in alignment therewith. It is the pattern of the dosing apertures 44 of the aligned dosing array 46 that dictates from which of the wells 18 microtablets may be dispensed.

Figure 11:
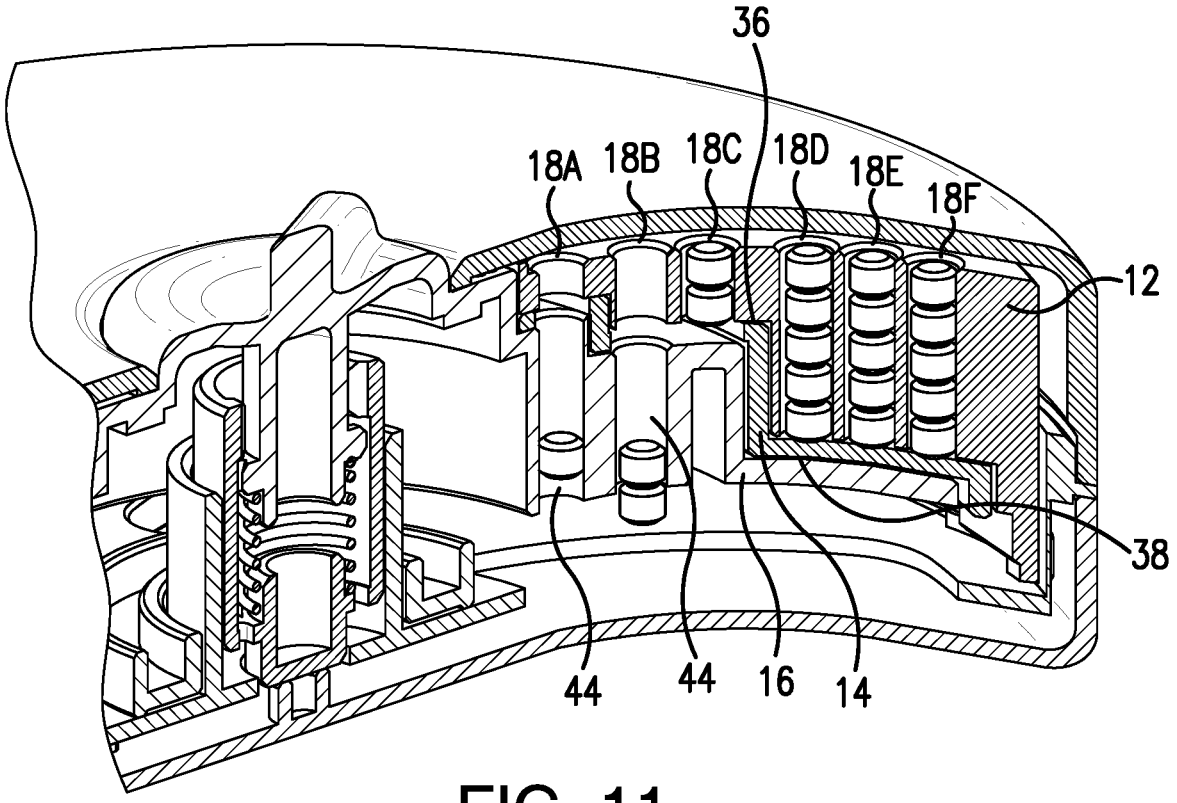
FIG. 11 depicts dispensing of a three microtablet dose.
Figure 12:
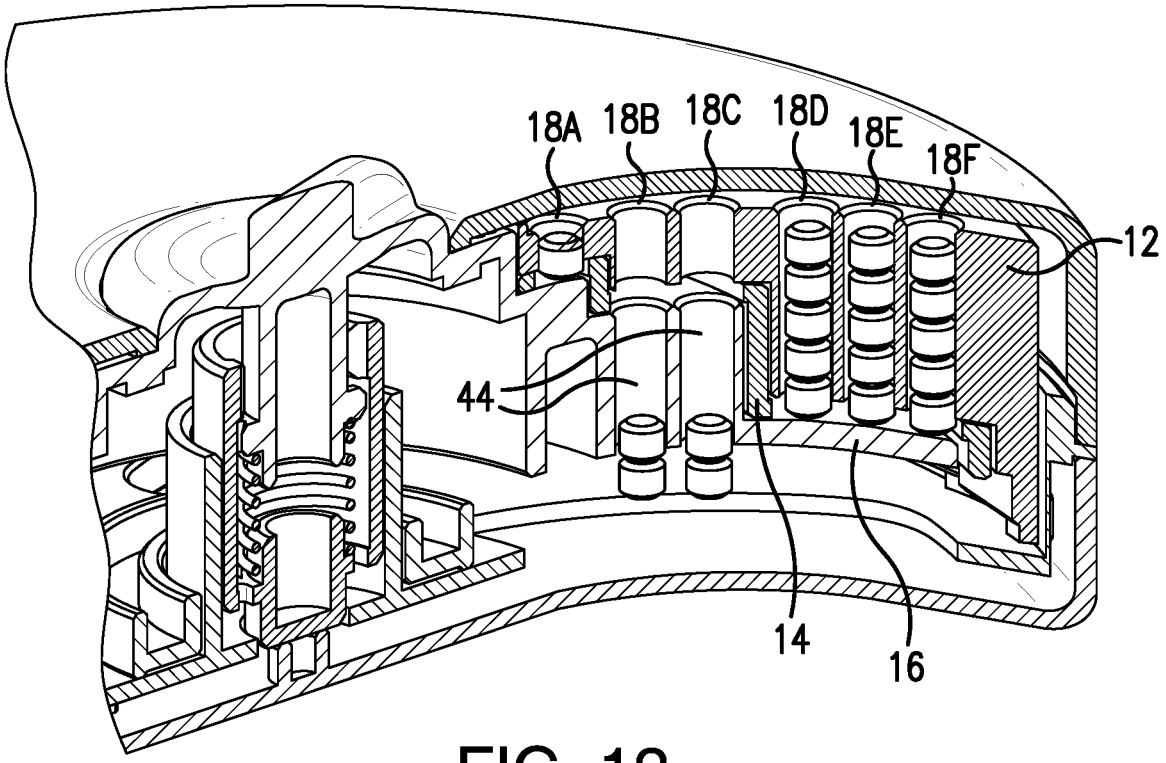
FIG. 12 depicts dispensing of a four microtablet dose.
Figure 13:
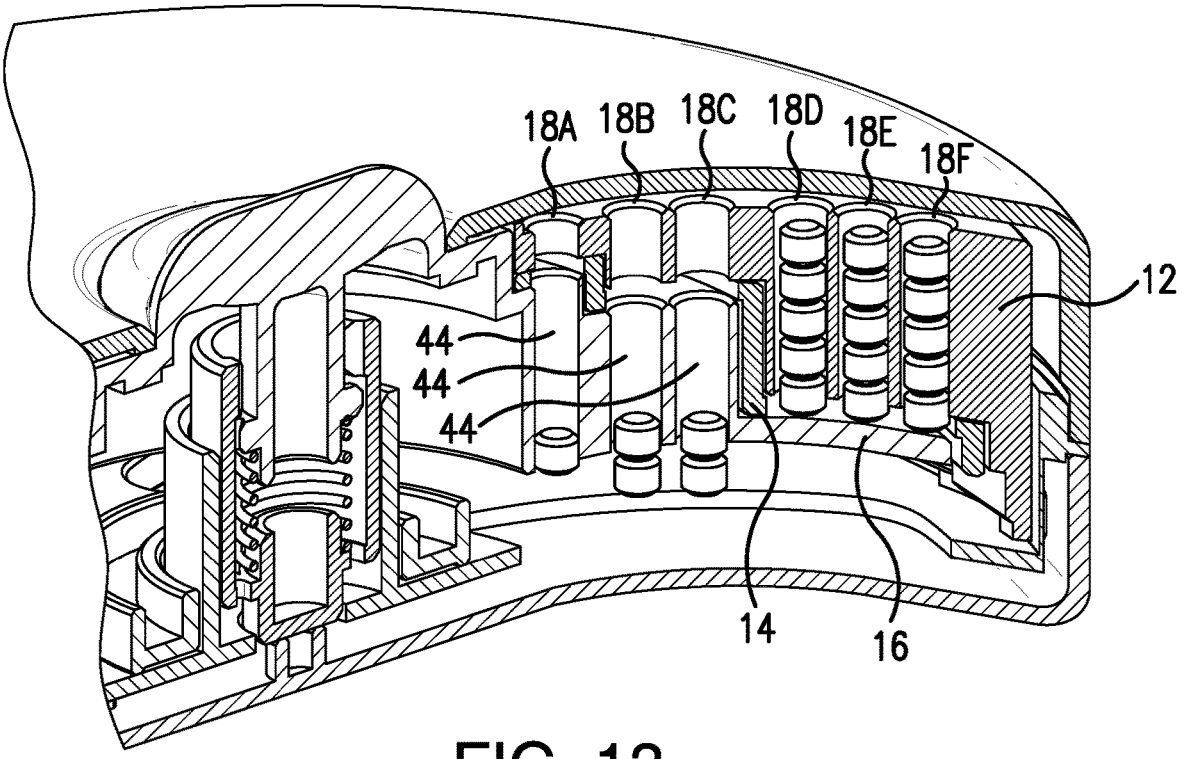
FIG. 13 depicts dispensing of a five microtablet dose.
Figure 14:
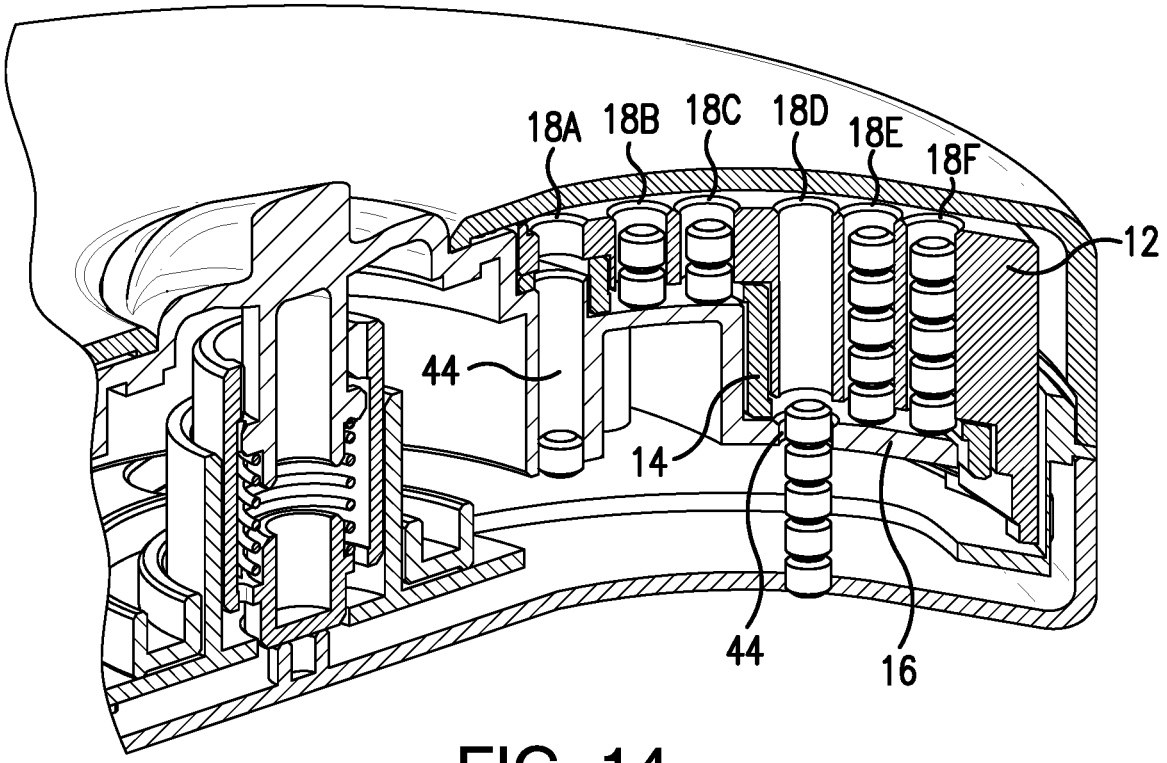
FIG. 14 depicts dispensing of a six microtablet dose.

The dosing arrays 46, shown in FIGS. 8 and 9, are configured to correspond to the arrays 20, shown in FIG. 5. It is preferred that for a given configuration of the arrays 20 (number, position, depth of the wells 18), the dosing arrays 46 vary to allow for different quantities of microtablets to be dispensed. By way of non-limiting example, and with use of the array 20 described above including six of the wells 18A-18F to dispense from one to twenty microtablets, twenty of the dosing arrays 46 may be provided, each set to allow for the dispensing of one to twenty microtablets in one-unit increments. The dosing apertures 44 of the dosing arrays 46 are arranged to expose the wells 18A-18F noted above to allow for the desired quantity of microtablets. For example, to dose one microtablet, only the first well 18A is exposed; this is achieved by providing a first of the dosing arrays 46 with one of the dosing apertures 44 positioned to align with the first well 18A. Solid portions of the dose selector plate 18 align with the second through sixth wells 18B-18F to prevent microtablets to be dispensed therefrom. FIG. 11 shows the dispensing of three microtablets; FIG. 12 shows the dispensing of four microtablets; FIG. 13 shows the dispensing of five microtablets; and, FIG. 14 shows the dispensing of six microtablets. As will be recognized by those skilled in the art, the dosing arrays 46 are similarly fashioned to accommodate dosing of two through twenty microtablets.

It is preferred that the dosing apertures 44, shown in FIG. 9, be arranged in rings on the dose selector plate 16 in similar fashion to the arrangement of the wells 18 on the reservoir disc 12, shown in FIG. 4, so that the dosing apertures 44 are alignable with the wells 18 from array to array. It is also preferred that the dose selector plate 16 have a profile matching that of the screen plate 14, e.g., being multi-tiered. The dosing apertures 44 may be distributed from tier to tier on the dose selector plate 16 in similar fashion to how the wells 18 are distributed from tier to tier on the reservoir disc 12. It is preferred that sufficiently low clearance be provided between the dose selector plate 16 and the screen plate 14 so that microtablets do not migrate between the dose selector plate 16 and the screen plate 14 from one of the wells 18 which is intended to be obstructed.

An upstanding handle 48 is provided on the dose selector plate 16 which is engageable by a user to rotate the dose selector plate 16 in setting a dose, as shown in FIGS. 8 and 10. The handle 48 extends through the central opening 42, shown in FIGS. 6-7, of the screen plate 14 and through the central opening 22, shown in FIGS. 2-3, of the reservoir disc 12. The handle 48 allows the dose selector plate 16 to be rotated relative to both the screen plate 14 and the reservoir disc 12. As shown in FIG. 8, indicia 50 representing different doses may be provided on the handle 48. Alignment of indicia 50 with a pointer or within a window causes the dosing array 46 corresponding to a desired dose to be aligned with the at least one window 40. As shown in FIGS. 8-10, the handle 48 may be provided integrally with the dose selector plate 16. Alternatively, as shown in FIG. 1, the handle 48 may be provided as a separate component from the dose selector plate 16, configured to be non-rotatably mounted to the dose selector plate 16.

The dispenser 10 is readied for dispensing a dose with rotational adjustment of the dose selector plate 16 relative to the screen plate 14 to align a selected dosing array 46 with a predefined dosing position. The dosing position may be a radially fixed virtual location, which allows for consistent dosing from the same location on the dispenser 10. The selected dosing array 46 represents the desired quantity of microtablets for the dose. Thereafter, the at least one opening 40 and one of the arrays 20 are caused to align with the selected dosing array 46 in the dosing position. With this configuration, the wells 18 are aligned with the dosing apertures 44 based on the pattern of the dosing array 46. Microtablets accommodated in the wells 18 aligned with the dosing apertures 44 are free to pass through the at least one opening 40 and the corresponding dosing aperture 46 so as to be dispensed therefrom. The wells 18 not aligned with any of the dosing apertures 44 are obstructed by solid portions of the dose selector plate 16 preventing the dispensing of microtablets accommodated therein.

Figure 15:
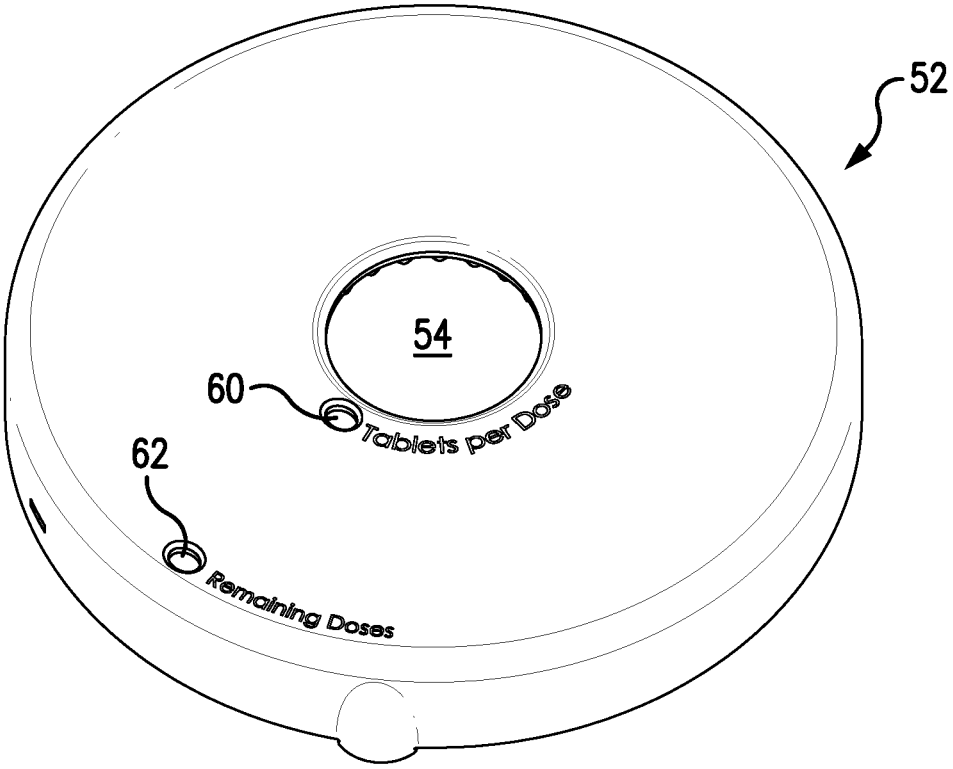
FIG. 15 shows a top housing useable with the subject invention.
Figure 16:
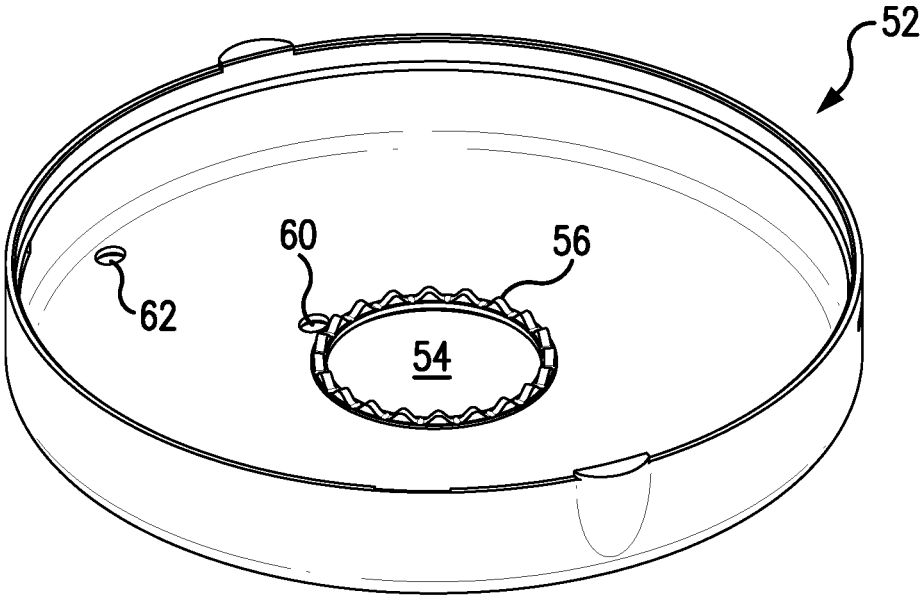
FIG. 16 shows a top housing useable with the subject invention.

As shown in FIGS. 15-16, a top housing 52 may be provided for overlaying over the reservoir disc 12, shown in FIG. 2, particularly to cover all of the wells 18, if exposed, on the upper face 34. The top housing 52 may include an access opening 54 through which the handle 48 of the dose selector plate 16, shown in FIG. 5, may extend so as to be engaged and rotated for rotationally adjusting the dose selector plate 16. As shown in FIG. 5, saw teeth 56 may be provided about the perimeter of the access opening 54, particularly on an interior of the top housing 52, which are engageable by matching secondary saw teeth 58 located about the handle 48 on the dose selector plate 16. As assembled, the saw teeth 56 and the secondary saw teeth 58 mesh so as to provide for snap-click incremental adjustment therebetween, preferably, bi-directionally. Each incremental adjustment is preferably set to correspond with a different dosing array 46, shown in FIG. 8, being in alignment with the at least one opening 40 of screen plate 14, shown in FIG. 6.

As shown in FIGS. 15 and 16, a dosing window 60 may be formed in the top housing 52 through which the indicia 50 may be viewable by a user. With rotation of the dose selector plate 16, the user will view the corresponding dose size through the dosing window 60. In addition, a dose counter window 62 may be provided in the top housing 62 to allow the user to view the number of the current dose.

As shown in FIG. 2, the reservoir disc 12 may be provided with dose number indicia 64, e.g., along the outer edge 24, each associated with one of the arrays 20. In this manner, as the arrays 20 are advanced to dose, the corresponding dose number indicia 64 are viewable through the dose counter window 62 to provide the user with an indication of the number of remaining doses. The dispenser 10 may be provided with thirty of the arrays 20 so as to provide for a month's worth of drug which is taken once daily. The dose number indicia 64 may include numbers to represent the dose number and/or colors to indicate the extent of used doses (e.g., green indicating at least a certain number of remaining doses, yellow indicating a mid-range number of remaining doses, and red indicating approaching end of remaining doses).

Figure 17:
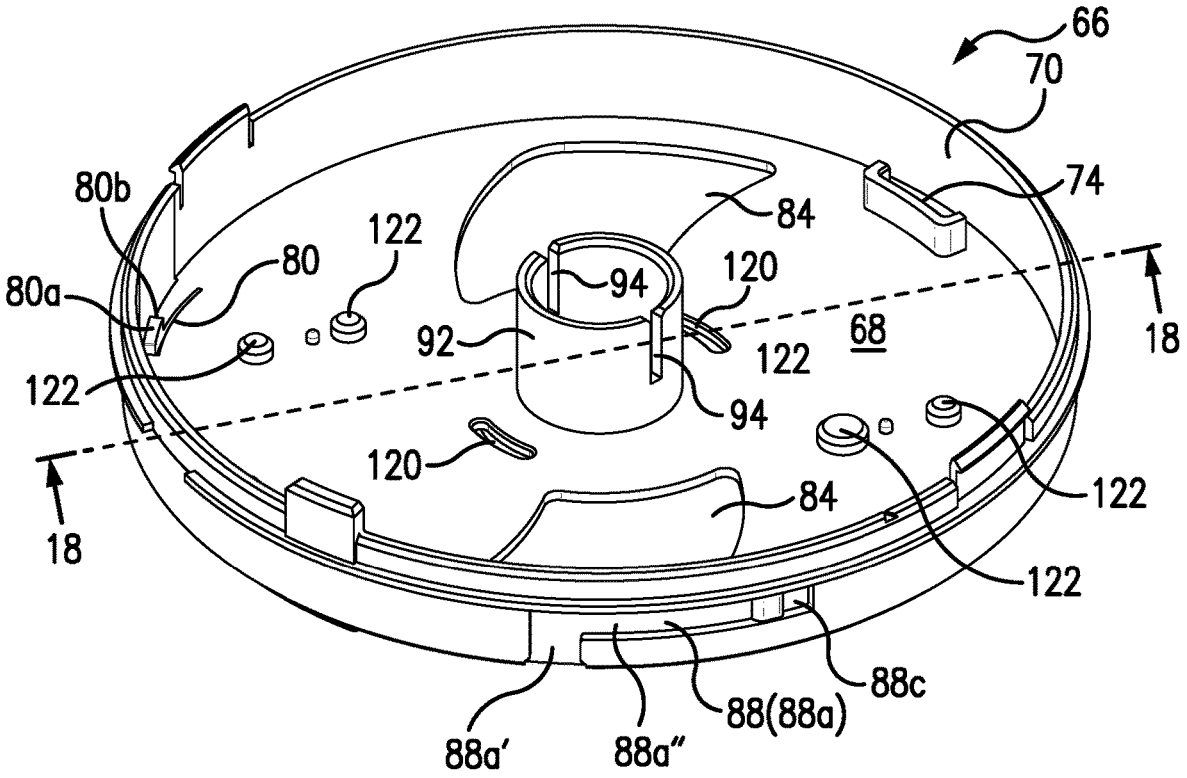
FIG. 17 shows a dosing plate useable with the subject invention.
Figure 18:
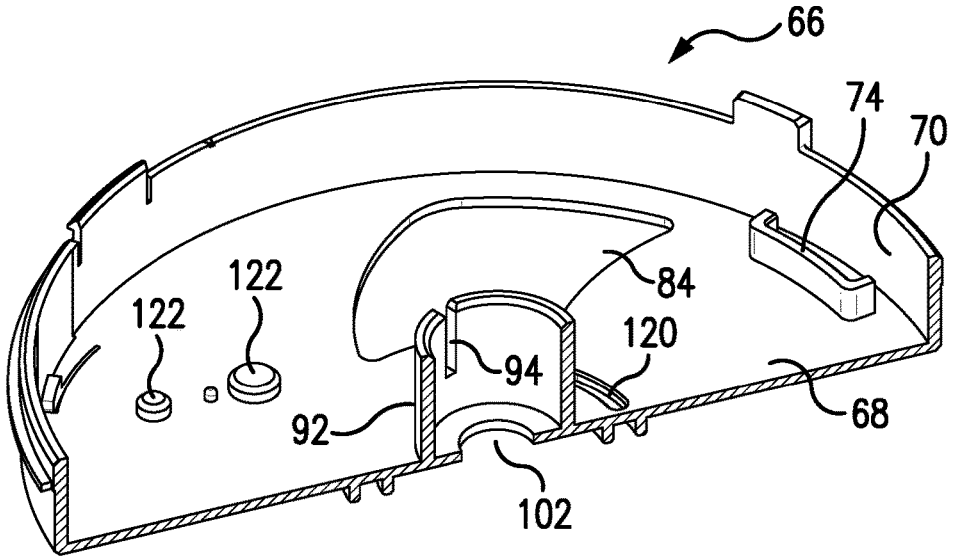
FIG. 18 is a cross-sectional view taken along line 18-18 of FIG. 17.

A dosing plate 66, as shown in FIGS. 17-18, may be provided with the dispenser 10 to facilitate repeated dosing. The dosing plate 66 includes a base 68 with an upstanding wall 70 perimetrically bounding the base 68. The top housing 52 may be secured to the wall 70 so as to not be rotatable relative to the dosing plate 66. The reservoir disc 12, the screen plate 14, and the dose selector plate 16 may be sandwiched between the top housing 52 and the dosing plate 66, as shown in FIG. 1.

As shown in FIG. 7, the screen plate 14 includes at least one downward depending tab 72, each received in a corresponding recess 74 formed in the dosing plate 66, of FIGS. 17 and 18. The interengagement of the tab 72 and the recess 74 prevents relative rotation between the screen plate 14 and the dosing plate 66. It is preferred that the tab 72 be located beyond the perimeter of the dose selector plate 16 so as to extend past the dose selector plate 16 into the tab 72 without impeding rotation of the dose selector plate 16. Preferably, a plurality of the tabs 72 and corresponding slots 74 be provided spaced apart about the dose selector plate 16.

Figure 19:
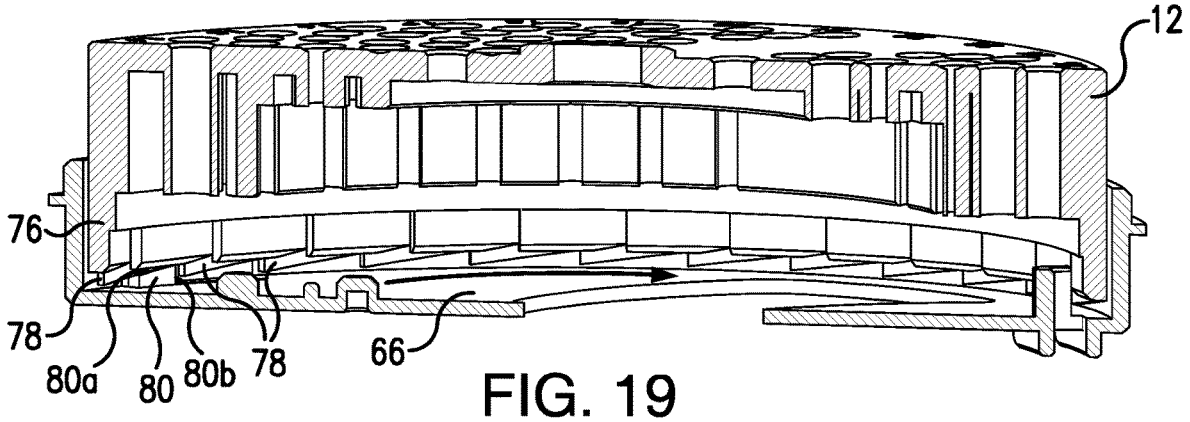
FIG. 19 shows schematically unidirectional rotation of the microtablet reservoir disc.

The reservoir disc 12 is preferably unidirectionally rotatable relative to the dosing plate 66. Any known configuration may be provided to achieve this arrangement. By way of non-limiting example, the reservoir disc 12 may include a downward depending skirt 76, located along the outer edge 24, having downward facing ratchet teeth 78, as shown in FIGS. 2 and 3, configured to be engaged by at least one one-way ramp 80 located on the dosing plate 66, as shown in FIG. 17. With this arrangement, as shown in FIG. 19, the reservoir disc 12 is rotatable in one direction with the ratchet teeth 78 riding up sloped side **80*a* of the ramp 80 to by-pass the ramp 80, with rotation in the reverse direction being restricted due to vertical side 80*b* of the ramp 80 which restricts by-passing of the ramp 80 in the reverse direction. The unidirection rotation of the reservoir disc 12 relative to the dosing plate 66, as represented by the arrow in FIG. 19, allows only for sequential advancement of the arrays 20 having full complements of microtablets contained therein. Reverse rotation prevents a partially full array 20, such as where a dose was dispensed less than the maximum dose, to re-align with the at least one aperture 40 to dispense a second time, possibly incorrectly. The skirt 76 is preferably configured to pass beyond the perimeter of the screen plate 14, thus, by-passing both the screen plate 14 and the dose selector plate 16**.

Figure 20:
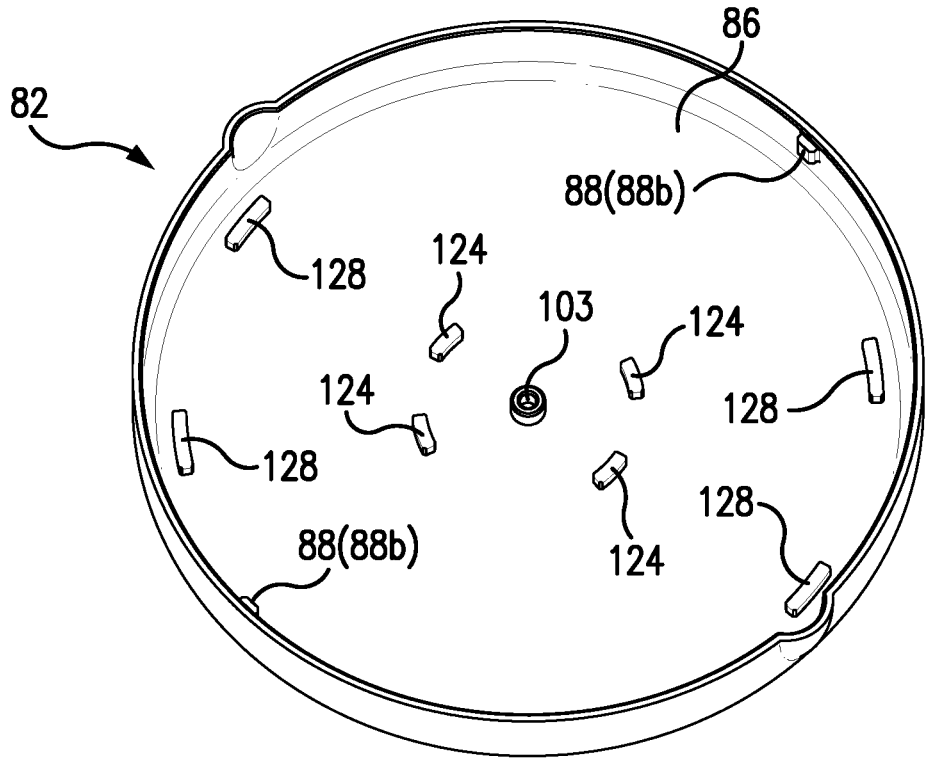
FIG. 20 shows a removable cover useable with the subject invention.

As shown in FIG. 20, a removable cover 82 may be provided for the dispenser 10 which is removably mountable to the dosing plate 66. The dosing plate 66 preferably includes at least one dosing aperture 84 through which microtablets dispensed from the dosing apertures 44 may pass through. The removable cover 82 includes a base 86 which may be positioned below the dosing plate 66 to collect microtablets passing through the at least one dosing aperture 84. A user may access the microtablets collected on the base 86.

Figure 21:
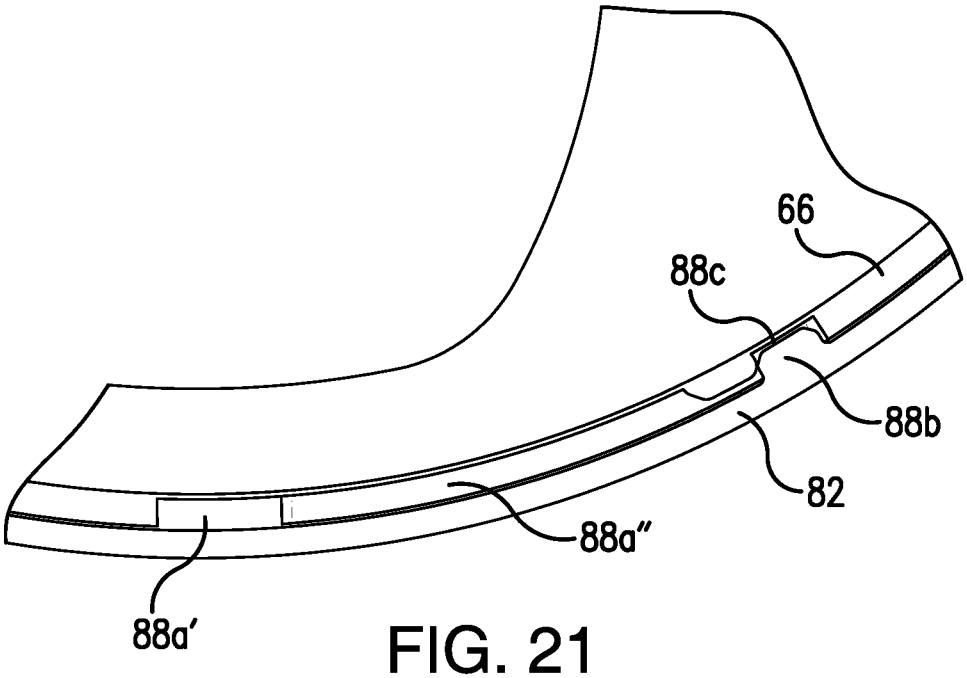
FIG. 21 shows schematically a bayonet-lock arrangement useable with the subject invention.

Any configuration which permits removable mounting may be used between the dosing plate 66 and the removable cover 82. It is preferred that the removable mounting require relative rotation between the dosing plate 66 and the removable cover 82. In a preferred arrangement, as shown in FIG. 21, cooperating bayonet lock elements 88 may be provided to allow for removable mounting, with a bayonet lock channel 88*a* being defined in an exterior surface of the wall 70 and a bayonet lock tab 88*b* extending inwardly from the removable cover 82 formed to slide through the bayonet lock channel 88*a*. The bayonet lock channel 88*a* may be formed with a first, upright section 88*a*' which is open at the bottom of the wall 70 to receive the bayonet lock tab 88*b* and a second, horizontal section 88*a*" into which the tab 88*b* may be seated. Relative rotation between the dosing plate 66 and the removable cover 82 is needed to remove the bayonet lock tab 88*b* from the bayonet lock channel 88*a*. A plurality of sets of the bayonet lock elements 88 may be used spaced about the dosing plate 66. Alternatively, mating threads may be utilized. As shown in FIG. 17, a locking depression 88*c* may be provided axially aligned with, but spaced from, the horizontal section 88*a*". As shown in FIG. 21, the tab 88*b* may be reversibly rotated into and from the locking depression 88*c*. Receipt of the tab 88*b* in the locking depression 88*c* provides the dispenser 10 with a releasable lock for maintaining the removable cover 82 in a fixed position on the dosing plate 66.

The dose selector plate 16 is preferably selectively fixable to the dosing plate 66 so that, in a first state, the dose selector plate 16 is not fixed to the dosing plate 66 (the dose selector plate 16 being rotatable relative to the dosing plate 66 in both directions), and, in a second state, the dose selector plate 16 is fixed to the dosing plate 66 such that there is no relative rotation therebetween.

Figure 22:
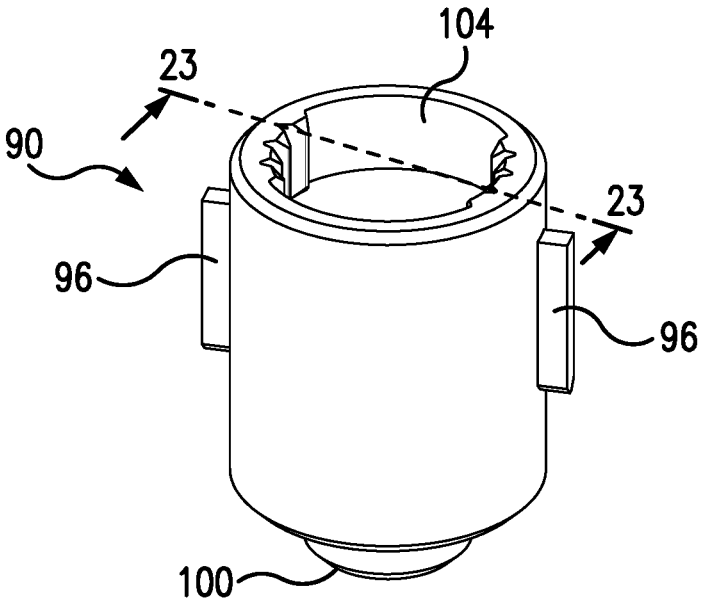
FIG. 22 shows a coupling useable with the subject invention.
Figure 23:
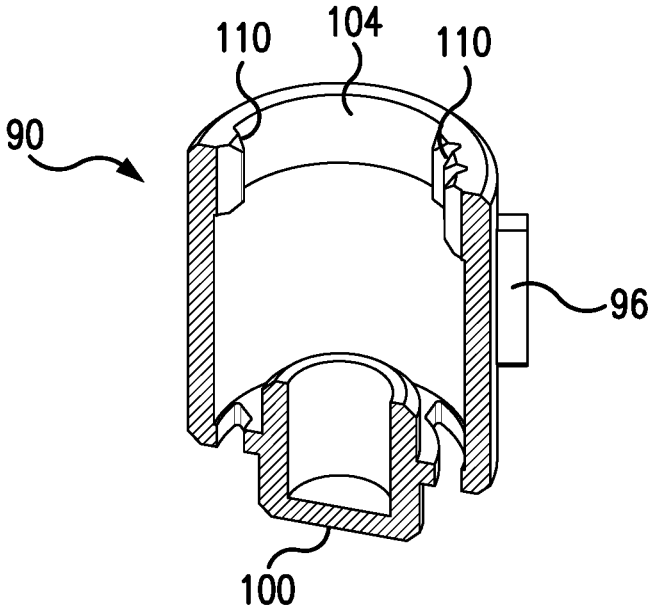
FIG. 23 is a cross-sectional view taken along line 23-23 of FIG. 22.

Any configuration to allow for selective fixing of the dose selector plate 16 to the dosing plate 66 may be utilized with the subject invention. By way of non-limiting example, as shown in FIGS. 22 and 23, a coupling 90 is formed to be disposed within an upstanding collar 92 defined in the dosing plate 66 so as to be movably adjustable therewithin (FIGS. 17 and 18). The collar 92 defines at least one channel 94 with the coupling 90 defining at least one tab 96 seated in the channel 94 of the collar 92 so as to prevent relative rotation between the coupling 90 and the dosing plate 66.

Figure 24:
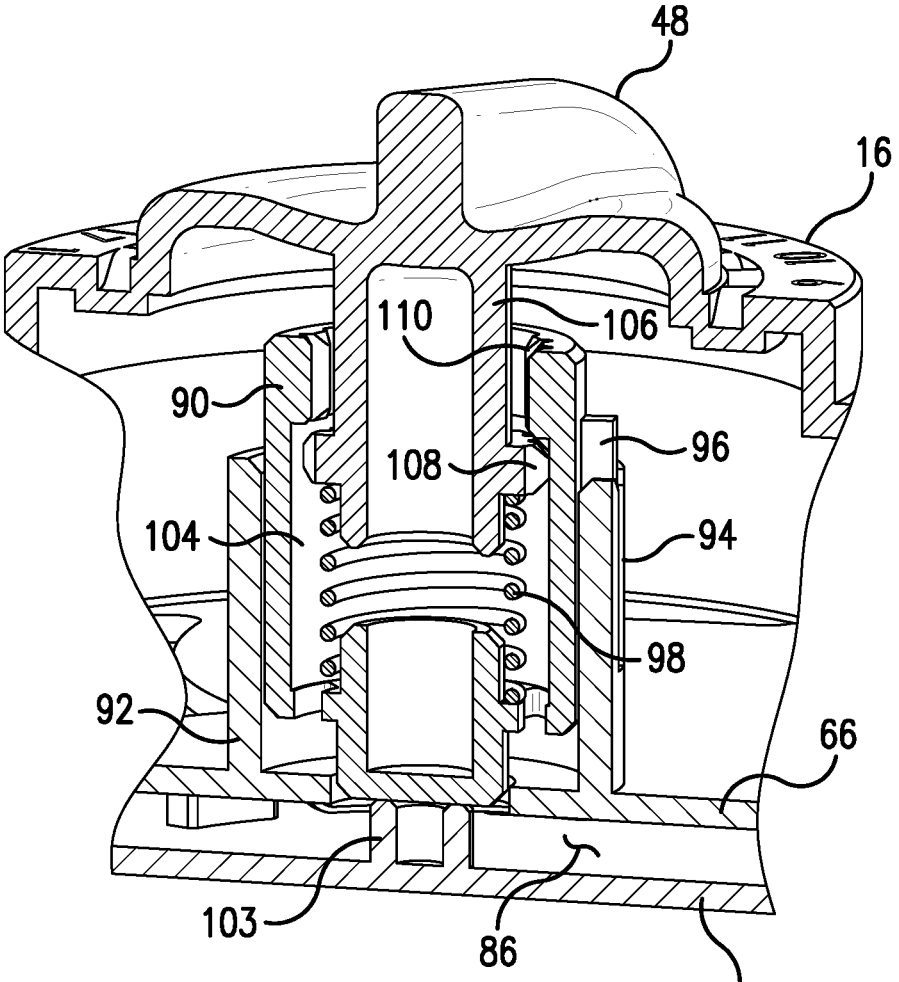
FIG. 24 shows an adjustable coupling arrangement useable with the subject invention.
Figure 25:
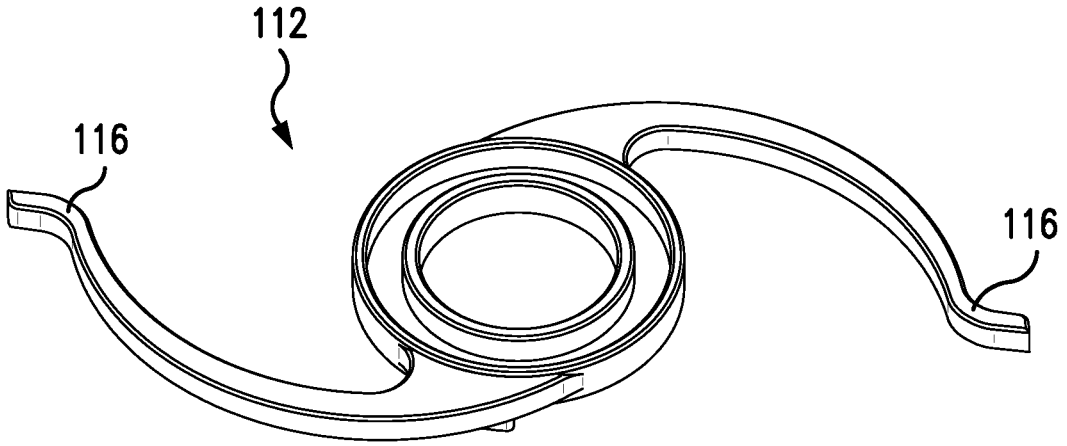
FIG. 25 shows a pawl useable with the subject invention.

As shown in FIG. 24, a spring 98 is provided to urge the coupling 90 from a first position to a second position relative to the collar 92. The spring 98 is positioned to act against a portion of the dose selector plate 16 and a portion of the coupling 90. As shown in FIGS. 22 and 23, the coupling 90 includes a button 100 formed to extend through button opening 102 of the dosing plate 66, shown in FIG. 18. The spring 98 acts against the coupling 90 to urge the button 100 outwardly through the button opening 102. A boss 103 may be provided on the base 86 of the removable cover 82 positioned to pressingly engage the button 100 with the removable cover 82 mounted to the dosing plate 66. As a result, the button 100 is caused to be depressed with the coupling 90 being in the first position. With removal of the removable cover 82 from the dosing plate 66, the spring 98 urges the coupling 90 downwardly to have the button 100 extend from the button opening 102 with the coupling 90 being urged to the second position.

As shown in FIGS. 10 and 24, the coupling 90 is preferably tubular having an internal passageway 104 with the dose selector plate 16 including a protruding stem 106 extending into the internal passageway 104 of the coupling 90. The stem 106 and the coupling 90 include interengageable elements 108, 110 which when engaged prevent relative rotation between the dose selector plate 16 and the coupling 90. The interengageable elements 110 may be formed within the internal passageway 104 of the coupling 90. The interengageable elements 108, 110 are preferably engaged with axial movement therebetween along a common axis; for example, the interengageable elements 108, 110 may be meshable teeth or cogs. With the coupling 90 being in the first position (i.e., with the removable cover 82 mounted to the dosing plate 66), the interengageable elements 108, 110 are not engaged with the dose selector plate 16 not fixed to the dosing plate 66, i.e., being freely rotatable relative to the dosing plate 66. With the coupling 90 being in the second position (i.e., with the removable cover 82 removed from the dosing plate 66), the interengageable elements 108, 110 are axially aligned to be engaged such that the dose selector plate 16 is fixed to the coupling 90 and, as such, fixed to the dosing plate 66.

Figure 26:
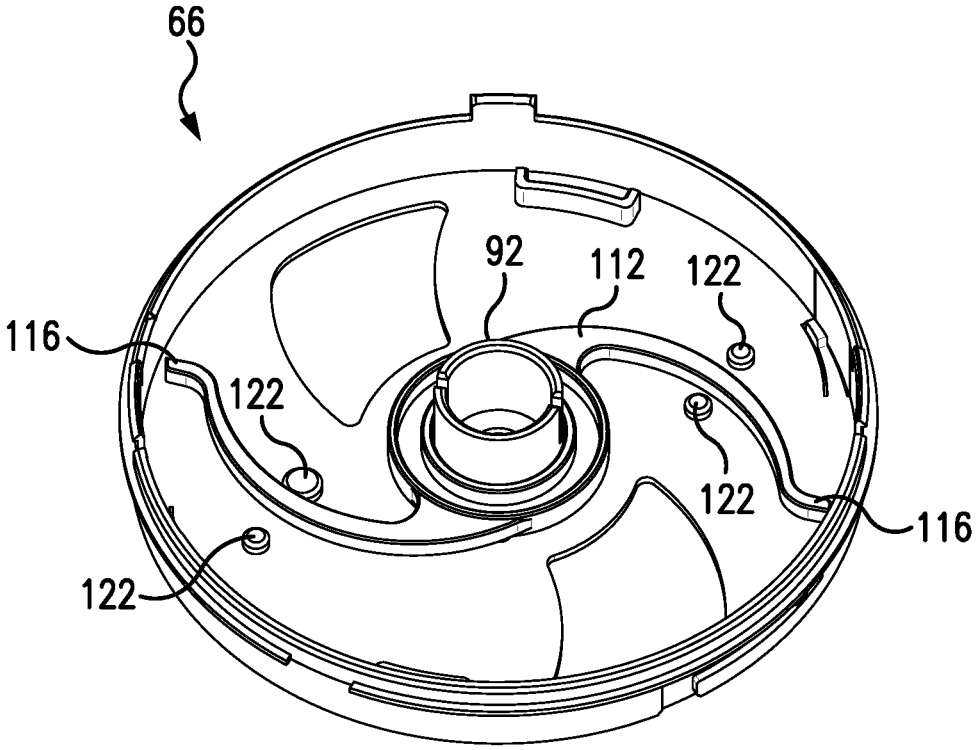
FIG. 26 shows a pawl useable with the subject invention.
Figure 27:
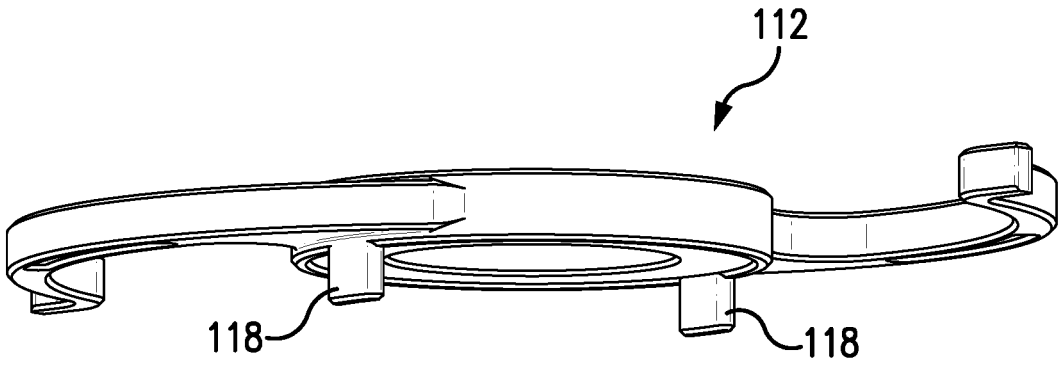
FIG. 27 shows a pawl useable with the subject invention.
Figure 28:
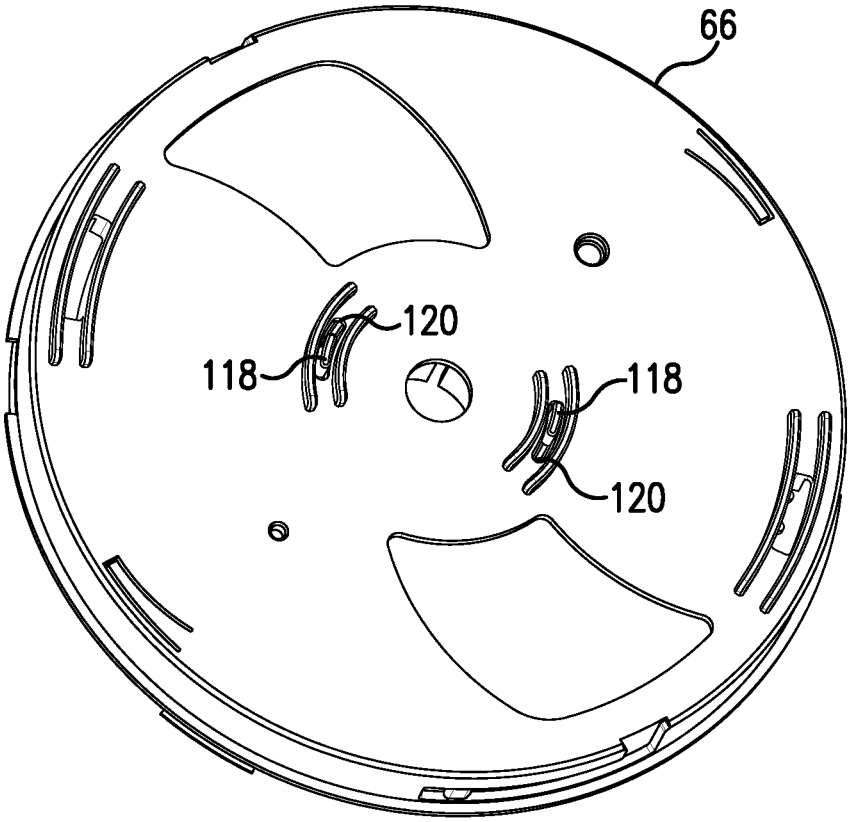
FIG. 28 shows a pawl useable with the subject invention.
Figure 29:
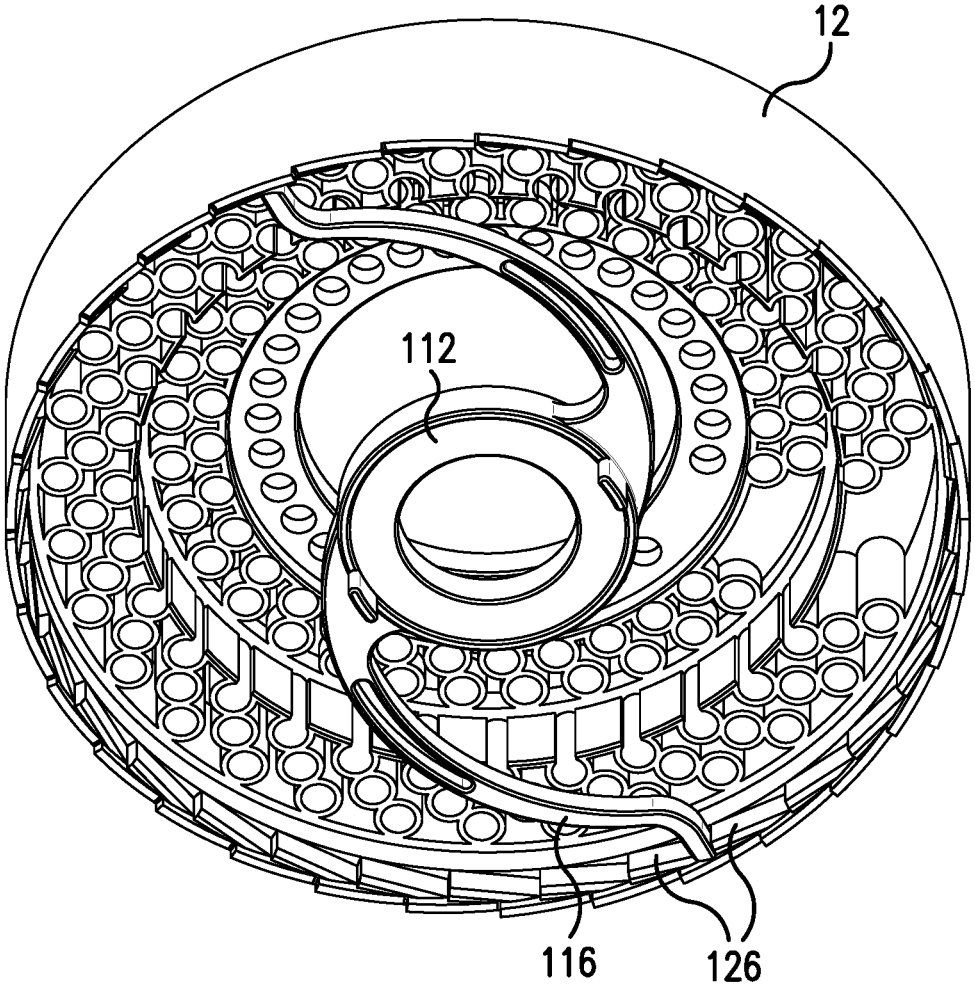
FIG. 29 shows a pawl useable with the subject invention.

As will be understood by those skilled in the art, the dose selector plate 16 requires rotation by a user to set a dose. Any arrangement may be used to rotate the reservoir disc 12 from dose to dose. An incremental rotational drive may be provided to cause the reservoir disc 12 to rotate incrementally for each dose. By way of non-limiting example, and as shown in FIGS. 25-28, a pawl 112 may be provided to nest on the collar 92 on the dosing plate 66. Preferably, the pawl 112 includes two flexible arms 116, but any quantity of arms may be utilized. The pawl 112 also includes at least one downward depending actuator tab 118, shown in FIG. 27 formed to extend through a corresponding rotation slot 120 formed in the dosing plate 66, shown in FIG. 28. As shown in FIGS. 17 and 18, a rotation slot 120 is formed with sufficient length to allow movement of the actuator tab 118 resulting in rotating movement of the pawl 112. As shown in FIGS. 17, 18 and 26, stop posts 122 are located on the dosing plate 66 about the arms 116 to define a range of movement therefor. Actuator detents 124, shown in FIG. 2) are provided on the base 86 of the removable cover 82 positioned to rotationally engage the actuator tabs 118 with the removable cover 82 being mounted to the dosing plate 66. Rotation of the removal cover 82 relative to the dosing plate 66 for removal of the removal cover 82 results in the actuator detents 124 rotating in engagement with the actuator tabs 118, resulting in rotation of the pawl 112. The extent of rotation of the pawl 112 may be limited by the length of the rotation slots 120 and the positioning of the stop posts 122, shown in FIGS. 17 and 18. Ratchet teeth 126 may be provided along an inwardly facing surface of the skirt 76, shown in Figure. The arms 116 of the pawl 112 act against the ratchet teeth 126 with the pawl 112 rotating so that the reservoir disc 12 is advanced an increment, as shown schematically in FIG. 29. This allows for one of the arrays 20 to come into alignment with the at least one opening 40. Re-mounting of the removable cover 82 causes reverse motion of the pawl 112. With the reservoir disc 12 resisting reverse motion, the arms 116 are caused to by-pass a select number of the ratchet teeth 126 with no rotation of the reservoir disc 12 relative to the dosing plate 66.

Figure 30:
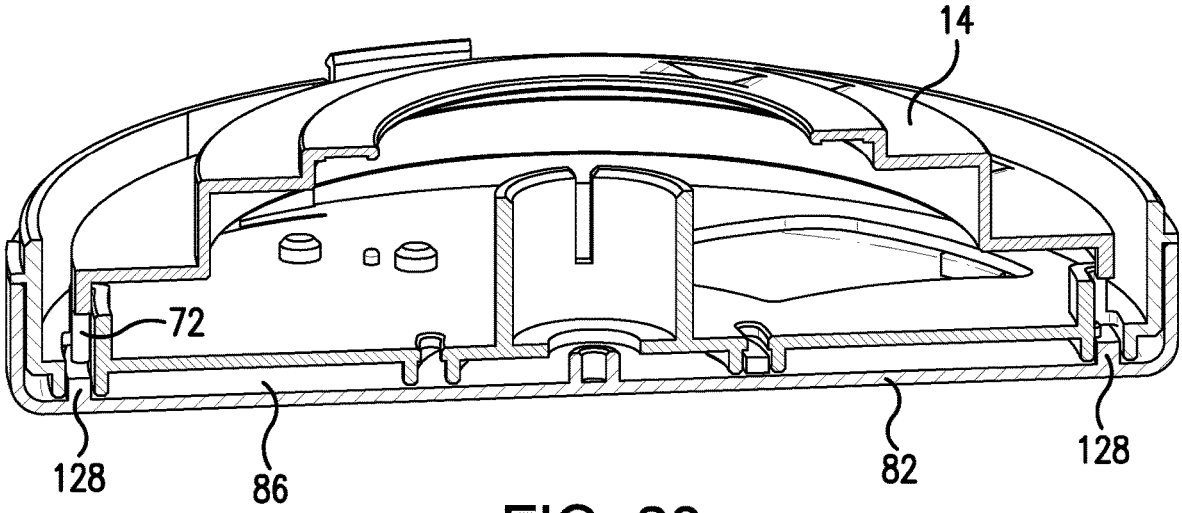
FIG. 30 shows a rotatable screen plate arrangement useable with the subject invention.
Figure 31:
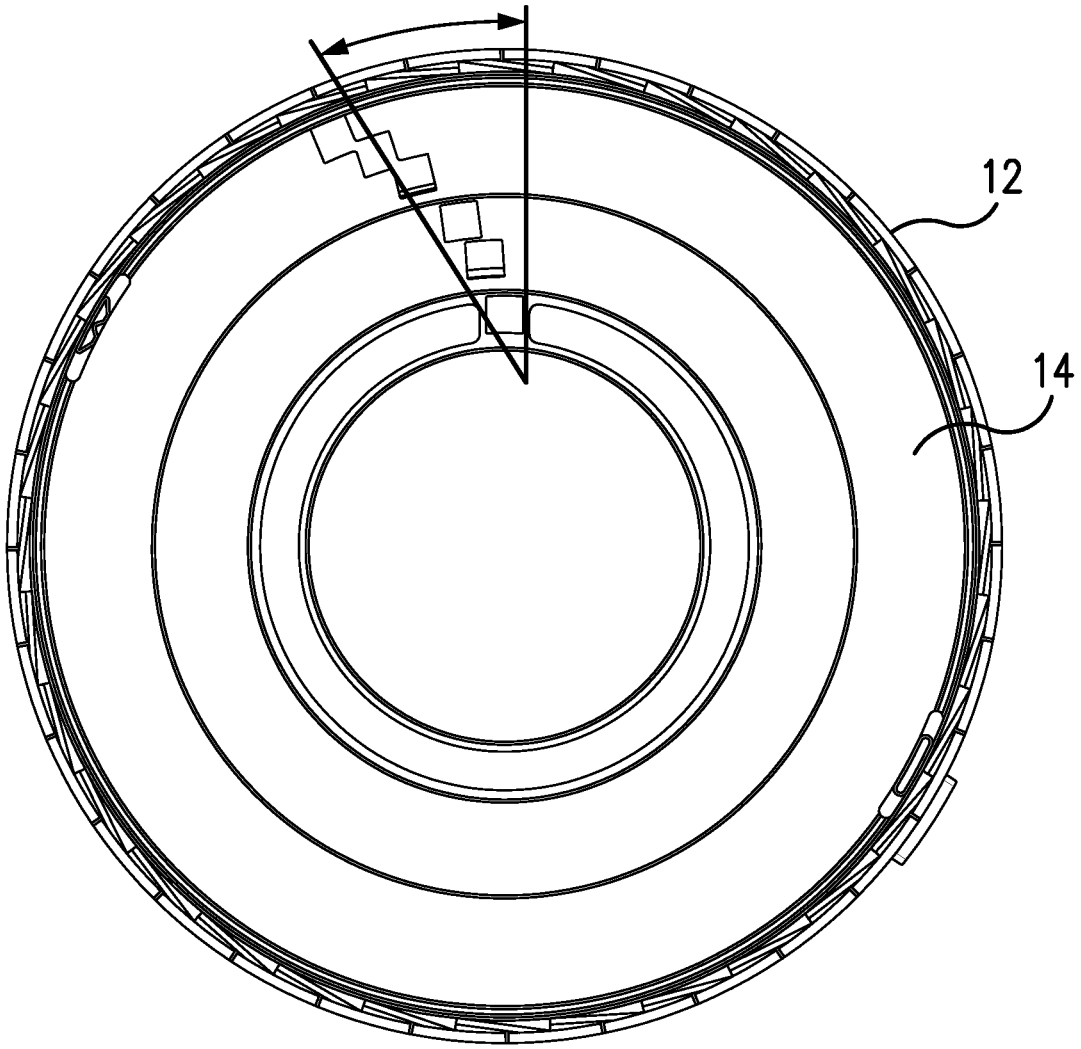
FIG. 31 shows a rotatable screen plate arrangement useable with the subject invention; and, FIG. 32 shows a microtablet dispenser in accordance with the subject invention.

As an additional feature, the screen plate 14 may be provided to be rotatable relative to the dosing plate 66. In particular, the tab 72 may be formed to extend through the recess 74. As shown in FIGS. 20 and 30, cogs 128 may be provided on the base 86 of the removable cover 82 to rotationally engage the tab 72. This allows for reversible rotation of the screen plate 14 relative to the dosing plate 66. Advantageously, the screen plate 14 may be caused to rotate the at least one opening 40 out of alignment with the array 20 from which microtablets are dispensed, after the dispensing. This allows for blocking any microtablets remaining in the array 20 and not allowing dispensing thereof. As shown in FIG. 31, the screen plate 14 may be rotated to have the at least one opening 40 in and out of phase with the target array 20 with the screen plate 14 being caused to rotate the at least one opening 40 out of phase with the target array 20 with the removable cover 82 being secured to the dosing plate 66 (for post-use storage) and caused to rotate the at least one opening 40 into phase with the target array 20 with the removable cover 82 being rotated for removal to cause microtablet dispensing.

Figure 32:
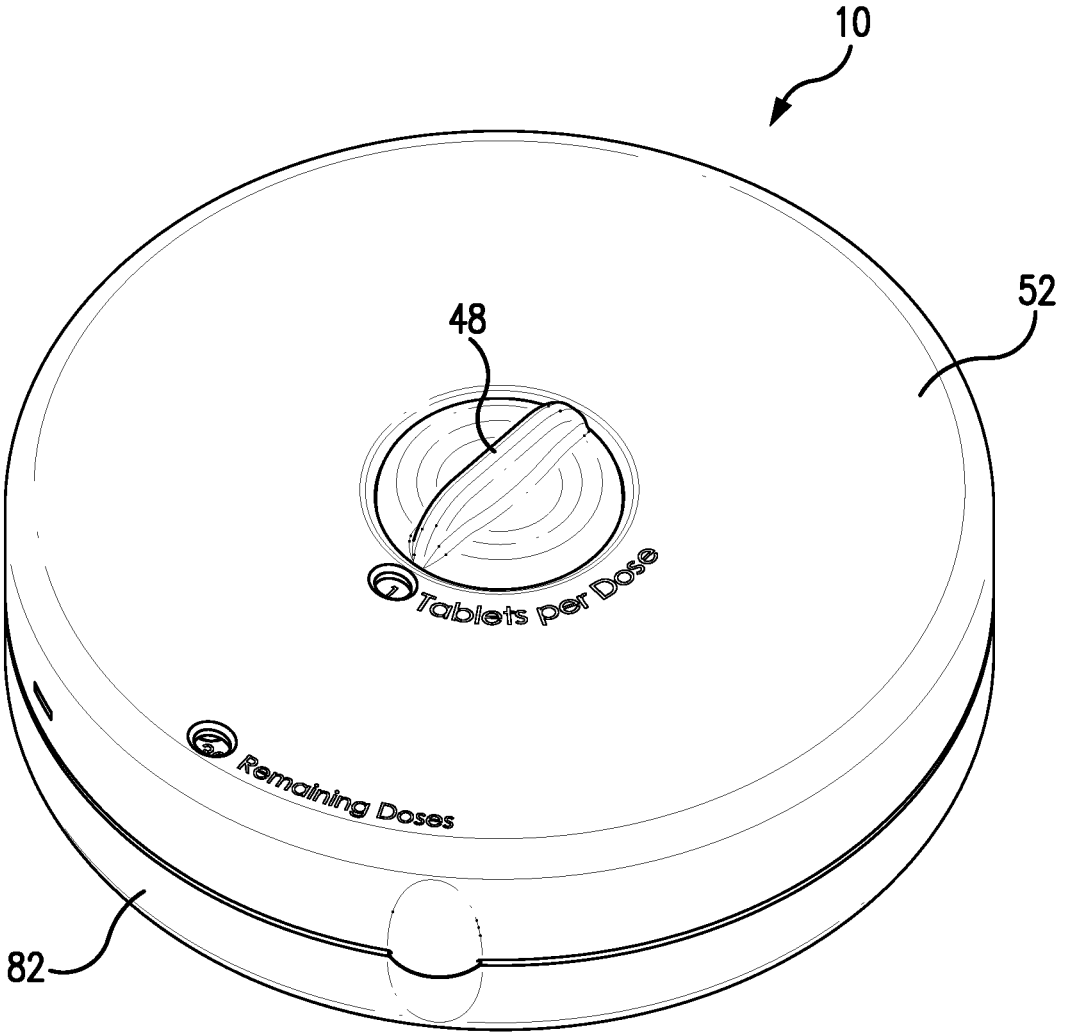

FIG. 32 shows an embodiment of the dispenser 10, ready for use. Dispenser 10 has a top housing 52 with an upstanding handle 48. In this state, the removable cover 82 is mounted to the dosing plate 66. To prepare for use, the dose selector plate 16, which is rotatable in both directions in the initial state, is rotated to a desired dosage amount. This readies the dispenser 10. Once readied, the removable cover 82 is caused to rotate relative to the dosing plate 66 resulting in the dose selector plate 16 being fixed in the selected position and resulting in the reservoir disc 12 being rotationally advanced an increment so that one of the arrays 20 comes into alignment with the at least one opening 40 and into alignment with the dosing array 46 corresponding to the selected dose. This causes the microtablets to dispense from the wells 18 which are exposed by the dosing apertures 44 of the dosing array 46. The microtablets fall, under force of gravity, through the at least opening 40, the corresponding dosing apertures 44, and the at least one dosing aperture 84, shown in FIGS. 17 and 18, formed in the dosing plate 66. Maintaining the removable cover 82 below the dosing plate 66 allows for the microtablets to collect on the base 86 of the removable cover. After dosing, the removable cover 82 is re-mounted to the dosing plate 66 to allow the process to be repeated. The re-mounting of the removable cover 82 may cause the at least one opening 40 to rotate out of phase with the array 20 from which the microtablets were dispensed. The size of each dose is independently settable with multiple doses being allowed.

What is claimed is:

1. A variable, multi-dose microtablet dispenser comprising:

a microtablet reservoir disc including a plurality of wells each formed to accommodate at least one microtablet, the wells being arranged in a plurality of discrete array;

a screen plate having opposing first and second faces and at least one opening therethrough shaped to expose all of the wells of one of the arrays when aligned therewith, wherein, the microtablet reservoir disc is located adjacent to the first face of the screen plate with the microtablet reservoir disc and the screen plate being rotationally adjustable relative to one another; and, a dose selector plate including a plurality of dosing apertures extending therethrough, the dosing apertures being arranged in a plurality of dosing arrays, each of the dosing arrays defining a different pattern of the dosing apertures, wherein, the dose selector plate being located adjacent to the second face of the screen plate, the dose selector plate being rotationally adjustable relative to the screen plate, wherein, the microtablet dispenser is readied for dispensing a dose with rotational adjustment of the dose selector plate relative to the screen plate to align a selected one of the dosing arrays with a dosing position, and, wherein, with a first of the arrays of the microtablet reservoir disc being in alignment with the at least one opening of the screen plate and with the selected dosing array in the dosing position, the wells of the first array shall be aligned with the dosing apertures of the selected dosing array based on the pattern of the dosing apertures of the selected dosing array such that the microtablets accommodated in the wells of the first array aligned with the dosing apertures of the selected dosing array are free to pass through the at least one opening and the corresponding dosing apertures so as to be dispensed therefrom, while the wells of the first array not aligned with the dosing apertures of the selected dosing array are obstructed by solid portions of the dose selector plate preventing the dispensing of the microtablets accommodated therein.

2. A microtablet dispenser as in claim 1, wherein, within the first array, first and second wells are formed with different depths to accommodate different first and second quantities of the microtablets.

3. A microtablet dispenser as in claim 2, wherein, the first array further including a third well formed with a different depth from the first and second wells so as to accommodate a third quantity of the microtablets different from the first and second quantities of the microtablets.

4. A microtablet dispenser as in claim 3, wherein, the first array further including fourth, fifth, and sixth wells, the fourth well being formed with the same depth as the second well, the fifth and sixth wells each being formed with the same depth as the third well.

5. A microtablet dispenser as in claim 4, wherein the first quantity is one, the second quantity is two, and the third quantity is five.

6. A microtablet dispenser as in claim 1, wherein, within the first array, the wells are arranged along an arc.

7. A microtablet dispenser as in claim 1, further comprising a top housing for overlaying over the microtablet reservoir disc.

8. A microtablet dispenser as in claim 7, wherein, the dose selector plate includes an upstanding handle, and, wherein, the top housing includes an access opening, the handle extending through the access opening so as to be engaged and rotated for rotationally adjusting the dose selector plate.

9. A microtablet dispenser as in claim 1, further comprising a dosing plate located adjacent the dose selector plate, the dosing plate including at least one dose aperture through which the microtablets dispensed from the dosing apertures may pass through.

10. A microtablet dispenser as in claim 9, further comprising a removable cover removably mountable to the dosing plate, wherein, the removable cover including a base positionable below the dose selector plate formed to collect the microtablets dispensed from the dosing apertures.

11. A microtablet dispenser as in claim 10, wherein, the cover and the dosing plate includes cooperating bayonet lock elements to allow for the removable mounting of the cover to the dosing plate.

12. A microtablet dispenser as in claim 9, wherein, the screen plate is fixed to the dosing plate such that there is no relative rotation therebetween.

13. A microtablet dispenser as in claim 12, wherein, the screen plate is fixed to the dosing plate such that the at least one opening of the screen plate is aligned with the dosing position.

14. A microtablet dispenser as in claim 9, wherein, the screen plate is rotatable relative to the dosing plate to allow for rotational movement in and out of alignment with the dosing position.

15. A microtablet dispenser as in claim 14, wherein, the screen plate is rotated out of alignment with the dosing position after the microtablets have been dispensed from the first array.

16. A microtablet dispenser as in claim 14, wherein, the screen plate includes at least one downwardly depending tab received in a corresponding recess formed in the dosing plate.

17. A microtablet dispenser as in claim 16, wherein, the at least one tab extends through the corresponding recess, the corresponding recess being configured to allow a fixed range of rotational movement of the at least one tab therewithin to define a fixed range of rotation of the screen plate.

18. A microtablet dispenser as in claim 17, further comprising a removable cover removably mountable to the dosing plate.

19. A microtablet dispenser as in claim 18, wherein, one or more cogs are defined on the cover which cause rotational movement of the at least one tab with relative rotation between the cover and the dosing plate, the rotational movement being reversible to selectively cause the screen plate to rotate in and out of alignment with the dosing position.

20. A microtablet dispenser as in claim 9, wherein, the dose selector plate is selectively fixable to the dosing plate, wherein, in a first state, the dose selector plate is not fixed to the dosing plate with the dose selector plate being rotatable relative to the dosing plate.

21. A microtablet dispenser as in claim 20, further comprising a spring-biased coupling movably adjustable within an upstanding collar defined in the dosing plate, the collar defining at least one channel, the coupling defining at least one tab seated in the channel of the collar so as to prevent relative rotation between the coupling and the dosing plate, wherein, with the cover mounted to the dosing plate, the coupling is in a first position relative to the collar.

22. A microtablet dispenser as in claim 21, wherein, the coupling is tubular having an internal passageway, the dose selector plate including a protruding stem extending into the internal passageway of the coupling, wherein, the stem and the coupling defining interengageable elements which when engaged prevent relative rotation between the dose selector plate and the coupling, wherein, the interengageable elements are not engaged with the coupling in the first position thereby providing the first state where the dose selector plate is not fixed to the dosing plate.

23. A microtablet dispenser as in claim 9, wherein the microtablet reservoir disc is unidirectionally rotatable relative to the dosing plate.

24. A microtablet dispenser as in claim 23, wherein, the microtablet reservoir disc includes a downwardly extending skirt defining ratchet teeth, and, wherein, the dosing plate defines at least one ramp which is configured to allow the ratchet teeth to pass over but restrict reverse rotation.

25. A microtablet dispenser as in claim 23, further comprising at least one pawl formed to rotatationally advance the microtablet reservoir disc in fixed increments.

26. A microtablet dispenser as in claim 25, further comprising a removable cover removably mountable to the dosing plate.

27. A microtablet dispenser as in claim 26, wherein, one or more detents are defined on the cover which cause rotational movement of the pawl with relative rotation between the cover and the dosing plate, the rotational movement of the pawl causing the microtablet reservoir disc to rotationally advance.

* * * * *